US011930927B2

(12) United States Patent
Andersson

(10) Patent No.: US 11,930,927 B2
(45) Date of Patent: Mar. 19, 2024

(54) DRAWER SLIDE FOR GUIDING A DRAWER IN A CABINET

(71) Applicant: IKEA Supply AG, Pratteln (CH)

(72) Inventor: Benny Andersson, Almhult (SE)

(73) Assignee: IKEA Supply AG, Pratteln (CH)

( * ) Notice: Subject to any disclaimer, the term of this patent is extended or adjusted under 35 U.S.C. 154(b) by 0 days.

(21) Appl. No.: 16/966,171

(22) PCT Filed: Jan. 30, 2019

(86) PCT No.: PCT/SE2019/050071
§ 371 (c)(1),
(2) Date: Jul. 30, 2020

(87) PCT Pub. No.: WO2019/151932
PCT Pub. Date: Aug. 8, 2019

(65) Prior Publication Data

US 2021/0037971 A1 Feb. 11, 2021

(30) Foreign Application Priority Data

Jan. 31, 2018 (SE) ..... 1850113-0

(51) Int. Cl.
*A47B 88/00* (2017.01)
*A47B 88/433* (2017.01)
*A47B 88/467* (2017.01)

(52) U.S. Cl.
CPC ..... *A47B 88/467* (2017.01); *A47B 88/433* (2017.01)

(58) Field of Classification Search
CPC ... A47B 88/467; A47B 88/433; A47B 88/453; A47B 88/60; A47B 88/41; A47B 88/437; A47B 2088/4675; A47B 88/50; A47B 88/487; A47B 2097/008
USPC ..... 312/319.1, 333, 334.12, 334.21, 334.42, 312/334.41, 334.19, 334.43
See application file for complete search history.

(56) References Cited

U.S. PATENT DOCUMENTS 1,172,711 A 2/1916 Hunter
2,577,724 A * 12/1951 Weller ..... A47B 1/05 108/72
2,586,543 A * 2/1952 Kennedy ..... B60N 3/002 312/231

(Continued)

FOREIGN PATENT DOCUMENTS

CN 2208365 Y 9/1995
CN 1949999 A 4/2007

(Continued)

OTHER PUBLICATIONS

English translation of JP H0773542 (Year: 1995).*

(Continued)

*Primary Examiner* — Janet M Wilkens
(74) *Attorney, Agent, or Firm* — Capitol City TechLaw

(57) ABSTRACT

A drawer slide is arranged for guiding a drawer (2, 4, 6) in an essentially linear movement as the drawer (2, 4, 6) is pulled out from a cabinet (8) to a static extended position (S). The drawer slide comprises at least one drawer biasing member arranged to bias the drawer (2) in a direction towards the cabinet (8) upon pulling the drawer (2, 4, 6) further away from the cabinet (8) beyond the static extended position (S) to a biased non-static extended position (B).

25 Claims, 12 Drawing Sheets

(56) References Cited

U.S. PATENT DOCUMENTS

| | | | | | |
|---|---|---|---|---|---|
| 3,026,149 | A | | 3/1962 | Ruhnke | |
| 3,243,247 | A | | 3/1966 | Knape | |
| 3,658,399 | A | * | 4/1972 | Vogt | A47B 88/57 312/334.41 |
| 3,954,531 | A | | 5/1976 | Comfort | |
| 3,973,814 | A | | 8/1976 | Entrikin | |
| 4,176,890 | A | * | 12/1979 | Gorton | A47B 88/487 312/334.41 |
| 4,447,095 | A | | 5/1984 | Fielding | |
| 5,302,030 | A | * | 4/1994 | Buie | A47B 88/437 384/57 |
| 5,490,724 | A | | 2/1996 | Domenig | |
| 5,785,400 | A | * | 7/1998 | Grieser | A47B 88/467 312/348.4 |
| 2010/0123378 | A1 | | 5/2010 | Chen et al. | |
| 2012/0248956 | A1 | * | 10/2012 | Netzer | A47B 88/493 384/19 |
| 2013/0113354 | A1 | * | 5/2013 | Dorsey | A47B 67/04 312/319.1 |
| 2017/0196356 | A1 | | 7/2017 | Gasser | |
| 2020/0072537 | A1 | * | 3/2020 | Oh | A47B 88/497 |

FOREIGN PATENT DOCUMENTS

| | | | | |
|---|---|---|---|---|
| CN | 107072394 | A | | 8/2017 |
| DE | 202009009566 | | * | 11/2009 |
| EP | 2100536 | | * | 9/2009 |
| JP | H0773542 | | * | 8/1995 |
| TW | 201019871 | A | | 6/2010 |
| WO | 03051156 | A1 | | 6/2003 |
| WO | 2019001954 | | * | 1/2019 |

OTHER PUBLICATIONS

Chinese Office Action for CN Application No. 201980010286.2 dated Sep. 15, 2021 (12 pages, with English translation).
International Search Report for International Application No. PCT/SE2019/050071 dated Mar. 15, 2019 (4 pages).
Extended European Search Report for EP Application No. 19748268.0 dated Sep. 29, 2021 (7 pages).

* cited by examiner

DRAWER SLIDE FOR GUIDING A DRAWER IN A CABINET

This application is a National Stage Application of PCT/SE2019/050071, filed 30 Jan. 2019, which claims benefit of Serial No. 1850113-0, filed 31 Jan. 2018 in Sweden and which applications are incorporated herein by reference. To the extent appropriate, a claim of priority is made to each of the above disclosed applications.

FIELD OF THE INVENTION

The present invention relates to a drawer slide for guiding a drawer in an essentially linear movement as the drawer is pulled out from a cabinet to a static extended position.

BACKGROUND OF THE INVENTION

Cabinets, such as cabinets of chests of drawers, are often provided with drawers for storing objects, such as clothes. If, for example, a user wants to put something in the drawer the user pulls out the drawer from the cabinet. To enable this movement of the drawer relative to the cabinet drawer slides are provided to connect the drawer to the cabinet in a manner which allows the drawer to be pulled out of the cabinet. When the user is ready the user pushes the drawer back into the cabinet. A concern with cabinets, such as chests of drawers, is that the chest of drawers may tip over if several drawers, loaded with goods, are open at the same time.

SUMMARY OF THE INVENTION

An object of the present invention is to provide an arrangement for reducing the possibility that a piece of furniture having drawers tips over.

This object is achieved by means of a drawer slide for guiding a drawer in an essentially linear movement as the drawer is pulled out from a cabinet to a static extended position, wherein the drawer slide comprises at least one drawer biasing member arranged to bias the drawer in a direction towards the cabinet upon pulling the drawer further away from the cabinet beyond the static extended position to a biased non-static extended position.

An advantage of this invention is that a user of the drawer can access a substantial portion of the interior of the drawer by applying a pulling force.

According to one embodiment the at least one drawer biasing member is arranged for automatically moving the drawer from the biased non-static extended position towards the static extended position when an external force pulling the drawer towards the biased non-static extended position has been discontinued.

An advantage of this embodiment is that the drawer, when not actively pulled outwardly by the user, will be located in a position relatively far inside the cabinet.

According to one embodiment the at least one drawer biasing member is a mechanical biasing member arranged for functioning in the absence of electrical power. An advantage of this embodiment is that the function of the drawer slide is independent from connection to electric power, batteries etc. so that it will always have a proper function.

According to one embodiment the at least one drawer biasing member is arranged for generating potential energy as the drawer is pulled from the static extended position towards the biased non-static extended position. An advantage of this embodiment is that potential energy is a reliable way of charging energy to the drawer biasing member, which energy can be used to return the drawer to the static extended position or even further into the cabinet.

According to one embodiment the drawer biasing member is arranged for generating a potential energy by at least one of: i) raising a portion of the drawer in a vertical direction, and ii) extending or compressing a spring member, such as a spring or a hydraulic or pneumatic cylinder. An advantage of raising a portion of the drawer is that the drawer slide is charged with energy based on the force of gravity which is an extremely reliably force, which is always available. In addition, the energy based on gravity will be higher the heavier the drawer, including things stored in the drawer. Hence a heavy drawer will also charge a large energy based on gravity, and therefore the energy for returning the drawer to the static extended position, or further into the cabinet, will be larger. An advantage of a spring member is that a spring member is efficiently charged with spring power, which can then be utilized for returning the drawer to the static extended position, or further into the cabinet.

According to one embodiment the drawer slide comprises a cabinet member arranged for being mounted to a cabinet and a drawer member arranged for being mounted to the drawer, the cabinet member and the drawer member being movable relative to each other in a horizontal direction and cooperating to allow the drawer to be pulled out of the cabinet. An advantage of this embodiment is that it provides for efficient mounting of the drawer to the cabinet in a movable manner.

According to one embodiment at least one of the cabinet member and the drawer member is provided with the at least one drawer biasing member, and wherein the other of the cabinet member and the drawer member cooperates with the drawer biasing member when said other of the cabinet member and the drawer member is in a position corresponding to the drawer being extended beyond the static extended position. An advantage of this embodiment is that it provides an efficient manner of mounting the drawer biasing member since it is mounted to the cabinet member and the drawer member that are also useful for enabling the movement of the drawer relative to the cabinet.

According to one embodiment the at least one drawer biasing member includes at least one drawer front raising portion arranged for moving a front of the drawer at least partly vertically upwards upon pulling the drawer outwardly beyond the static extended position. An advantage of this embodiment is that potential energy is efficiently charged to the drawer slide, and the drawer is given a position from which it has a strong, due to the force of gravity, tendency to move from the biased non-static extended position and towards the cabinet.

According to one embodiment the at least one drawer front raising portion comprises a portion of a track of at least one of the cabinet member and the drawer member being inclined relative to the horizontal plane, said track being in sliding contact with a slide member arranged on the other of the cabinet member and the drawer member. An advantage of this embodiment is that it provides a very cost efficient solution as it merely involves using parts that are anyway needed for the drawer slide being able to allow a drawer to move relative to a cabinet.

According to one embodiment a portion of a track of the cabinet member is inclined relative to the horizontal plane. This provides for a cost efficient and reliable arrangement of a drawer biasing member. Preferably said inclination corresponds to an angle (alfa2) to the horizontal plane of 0.5-8 degrees, more preferably 1.5-5 degrees. These angles have proven to provide an efficient movement of the drawer back towards the cabinet in combination with a pleasant user experience, when the user actively pulls a drawer towards the non-static extended position.

According to one embodiment a portion of a track of the drawer member is inclined relative to the horizontal plane. This provides for a cost efficient and reliable arrangement of a drawer biasing member. Preferably said inclination corresponds to an angle (alfa1) to the horizontal plane of 0.5-8 degrees, preferably 1.5-5 degrees. These angles have proven to provide an efficient movement of the drawer back towards the cabinet in combination with a pleasant user experience, when the user actively pulls a drawer towards the non-static extended position.

According to a further embodiment both a portion of a track of the cabinet member and a track of the drawer member are inclined relative to the horizontal plane. This provides for a cost efficient and reliable arrangement of a drawer biasing member. Preferably said inclination corresponds to a total angle (alfa1+alfa2) to the horizontal plane of 1-8 degrees, preferably 1.5-5 degrees. These angles have proven to provide an efficient movement of the drawer back towards the cabinet in combination with a pleasant user experience, when the user actively pulls a drawer towards the non-static extended position.

According to one embodiment the drawer biasing member is arranged for inclining the drawer to raise the front portion of the drawer relative to the rear portion of the drawer upon pulling the drawer outwardly beyond the static extended position. An advantage of this embodiment is that the inclined drawer gives a visual indication to the user that the drawer is in a non-static extended position. Furthermore, a tendency of the drawer to hang down in the non-static extended position is counteracted.

According to one embodiment the at least one drawer biasing member comprises a spring arrangement arranged to bias the drawer in a direction towards the cabinet upon pulling the drawer further away from the cabinet beyond the static extended position to a biased non-static extended position. An advantage of this embodiment is that a spring arrangement can provide a reliable force biasing the drawer back into the cabinet.

According to one embodiment the drawer slide comprises a cabinet member arranged for being mounted to a cabinet and a drawer member arranged for being mounted to the drawer, the cabinet member and the drawer member being movable relative each other in a horizontal direction and cooperating to allow the drawer to be pulled out of the cabinet, the spring arrangement comprising a spring biasing member arranged on one of the cabinet member and the drawer member, the spring biasing member being arranged for co-operating with a spring member and for generating spring energy in the spring member upon pulling the drawer further away from the cabinet beyond the static extended position. An advantage of this embodiment is that the arrangement becomes efficient and with a low cost by arranging the spring biasing member arranged on one of the cabinet member the drawer member.

According to one embodiment the spring biasing member is arranged on one of the cabinet member and the drawer member and the spring member is arranged on the other one of the cabinet member and the drawer member. An advantage of this embodiment is that arrangement of the spring arrangement becomes efficient with regard to cost and space.

According to one embodiment the drawer slide is arranged to allow the drawer to be extended further away from the cabinet beyond the static extended position to a biased non-static extended position a distance corresponding to 5-30% of the inner total length of the drawer. An advantage of this embodiment is a good access to the drawer is achieved as the user gets access to a further 5-30% of the inner total length of the drawer by pulling the drawer to the biased non-static extended position.

According to one embodiment wherein the drawer slide comprises at least two drawer biasing members, at least one of which comprising a drawer front raising portion arranged for moving a front of the drawer at least partly vertically upwards upon pulling the drawer outwardly beyond the static extended position, and at least one of which comprising a spring arrangement arranged to bias the drawer in a direction towards the cabinet upon pulling the drawer further away from the cabinet beyond the static extended position. An advantage of this embodiment is that the manner in which the drawer is biased when pulling the drawer further away from the cabinet beyond the static extended position can be adapted for maximum pleasant feeling for a user. For example, the degree to which the front is raised by the drawer front raising portion may be reduced, thanks to the combination with the spring arrangement, which in some embodiments may give a more pleasant feeling.

According to one embodiment the drawer slide is a three quarter extendable drawer slide and is arranged to allow the drawer to be pulled out to a static extended position of a total length corresponding to maximum 75% of the inner total length of the drawer, preferably maximum 70% of the inner total length of the drawer, still more preferably the drawer slide is arranged to allow the drawer to be pulled out to a static extended position having a total length corresponding to maximum 50-70% of the inner total length of the drawer, preferably the drawer slide is arranged to allow the drawer to be extended to a non-static extended position at a length corresponding to maximum 90% of the inner total length of the drawer, preferably maximum 85% of the inner total length of the drawer, still more preferably the drawer slide is arranged to allow the drawer to be pulled out to a non-static extended position having a total length corresponding to maximum 65-85% of the inner total length of the drawer. An advantage of this embodiment is that a good access to items stored inside the drawer in the biased non-static extended position (B) can be achieved, and still a good margin against tip over of the cabinet is achieved in the static extended position (S).

According to a further aspect there is provided a cabinet and drawer combination, such as a chest of drawers, comprising a cabinet and at least one drawer wherein the cabinet and drawer combination comprises at least one drawer slide according to any one of the embodiments described above and arranged for making at least one drawer extendable from the cabinet. This cabinet and drawer combination provides for a pleasant user experience and reducing the possibility of tip over of the cabinet.

Furthermore, there is provided a method of controlling a drawer being connected to a drawer slide for guiding the drawer in an essentially linear movement as the drawer is pulled out from a cabinet to a static extended position, wherein the drawer slide comprises at least one drawer biasing member, the method comprising the drawer biasing member biasing the drawer in a direction towards the cabinet upon pulling the drawer further away from the cabinet beyond the static extended position (S) to a biased non-static extended position (B).

Further objects and features of the present invention will be apparent from the description and the claims.

BRIEF DESCRIPTION OF THE DRAWINGS

The invention will now be described in more detail with reference to the appended drawings in which.

DESCRIPTION OF PREFERRED EMBODIMENTS

Figure 1:
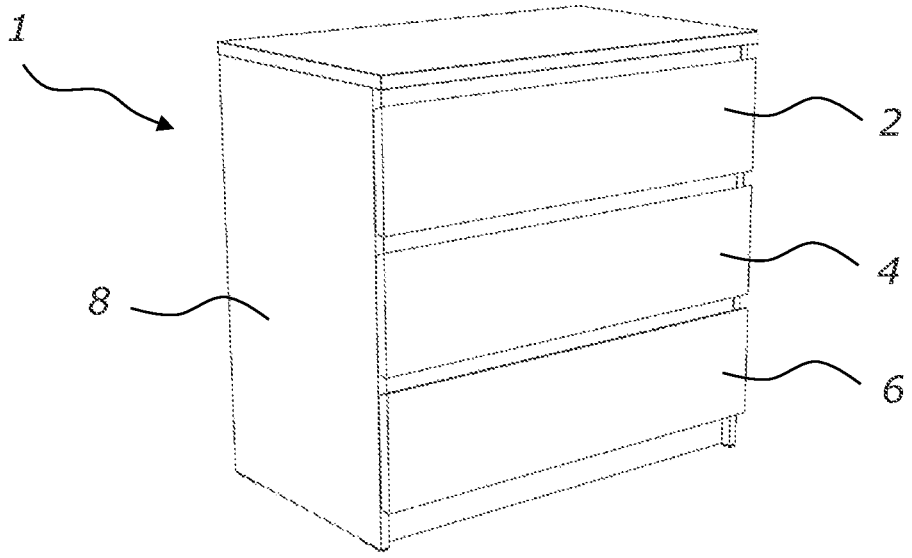
FIG. 1 illustrates a chest of drawers.

FIG. 1 illustrates a cabinet and drawer combination in the form of a chest of drawers 1 as seen in a front perspective view and having a first, upper, drawer 2, a second, central, drawer 4, and a third, lower, drawer 6. The three drawers 2, 4, 6 are arranged in a cabinet 8.

Figure 2:
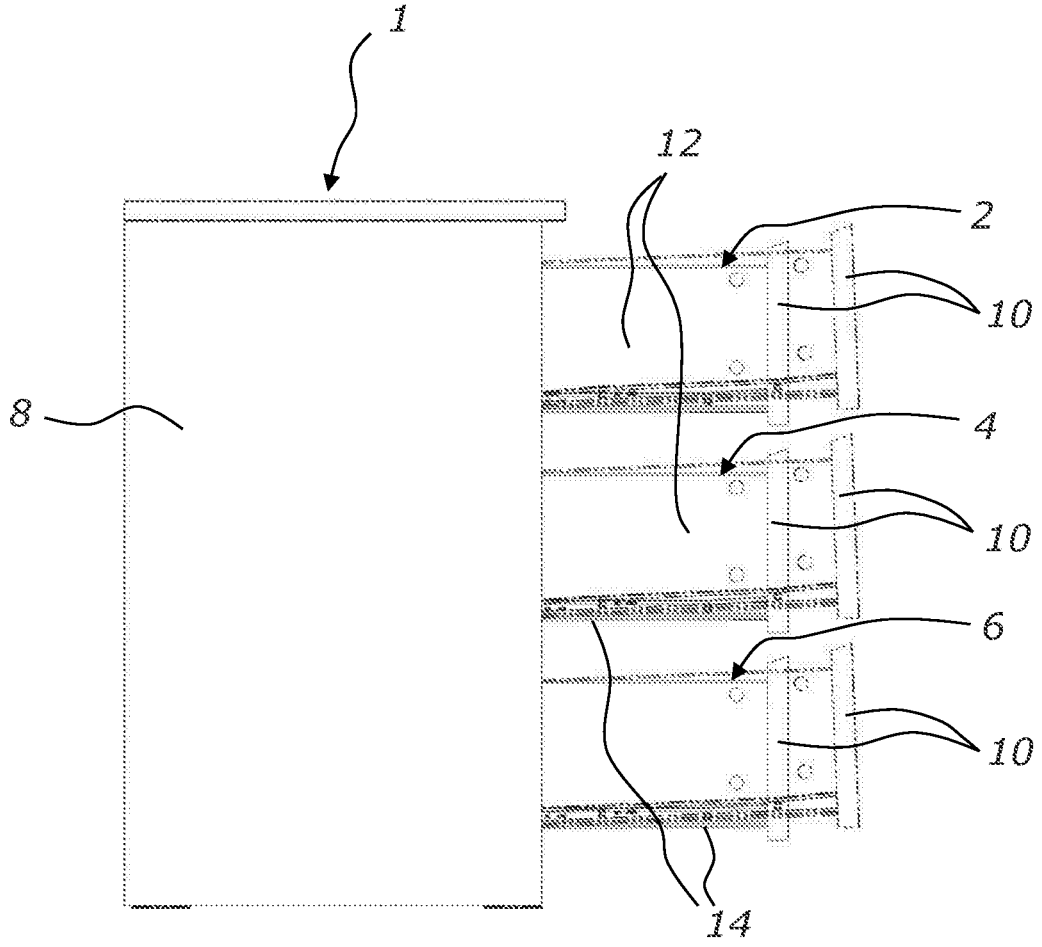
FIG. 2 illustrates the chest of drawers with the drawers extended to a static extended position and to a biased non-static extended position.

FIG. 2 illustrates the chest of drawers 1 as seen in a side view and with the three drawers 2, 4, 6 in static horizontally extended positions, shown with unbroken lines in FIG. 2, relative to the cabinet 8. Each drawer 2, 4, 6 has a respective front portion 10, respective side portions 12, a respective bottom portion 14, and a respective rear portion 16 (shown in FIG. 3).

In FIG. 2 the chest of drawers 1 is shown, in unbroken lines, with all three drawers 2, 4, 6 in the static horizontally extended position at the same time. However, this is just for illustrative purpose, and it will be realized that in reality a person using the chest of drawers 1 would often pull out one of the drawers 2, 4, 6 at a time.

In the static horizontally extended positions, as shown with unbroken lines in FIG. 2, a relatively large portion of the full length of the respective drawer 2, 4, 6 is still located inside the cabinet 8. For example, about 40% of the inner total length TL, see FIG. 3, of the respective drawer 2, 4, 6 may still be inside the cabinet 8, thereby the chest of drawers 1 is stable, and there is no possibility that it would tip over, to the right in the perspective of FIG. 2. The static horizontally extended positions are static positions, meaning the respective drawer 2, 4, 6 can stay in this position until a user decides to push the respective drawer 2, 4, 6 into the cabinet 8 or pull the drawer 2, 4, 6 further out of the cabinet 8.

If the drawers 2, 4, 6 are pulled further out of the cabinet 8 the drawers 2, 4, 6 will reach a biased non-static extended position, which in this embodiment is a raised position in the form of a non-static upwardly tilted extended position which is illustrated in FIG. 2 with broken lines. In this non-static upwardly tilted extended position the respective front portion 10 of the respective drawer 2, 4, 6 is raised above the position that the front portion 10 has in the static horizontal extended position. As will be described in more detail hereinafter the respective drawer 2, 4, 6 has, when being pulled out from the cabinet 8 to move from the static horizontal extended position to the non-static upwardly tilted extended position, travelled up what could be called a side of a hill. Thereby, the non-static upwardly tilted extended position, illustrated in FIG. 2 with dotted lines, is an non-static position, and as soon as a pulling force, as applied for example by the hand of a person pulling the drawer outwardly, is discontinued the respective drawer 2, 4, 6 will immediately return to the static horizontally extended position, or may even move further into the cabinet 8, as will be described in more detail hereinafter. In the non-static upwardly tilted extended position for example about 75% of the inner total length TL of the respective drawer 2, 4, 6 is located outside of the cabinet 8, which means that a person using the chest of drawers 1 can easily access any items stored in the respective drawer 2, 4, 6. However the drawer will only remain in the non-static upwardly tilted extended position as long as the person actively pulls the drawer outwardly by applying a pulling force by the hand.

Figure 3:
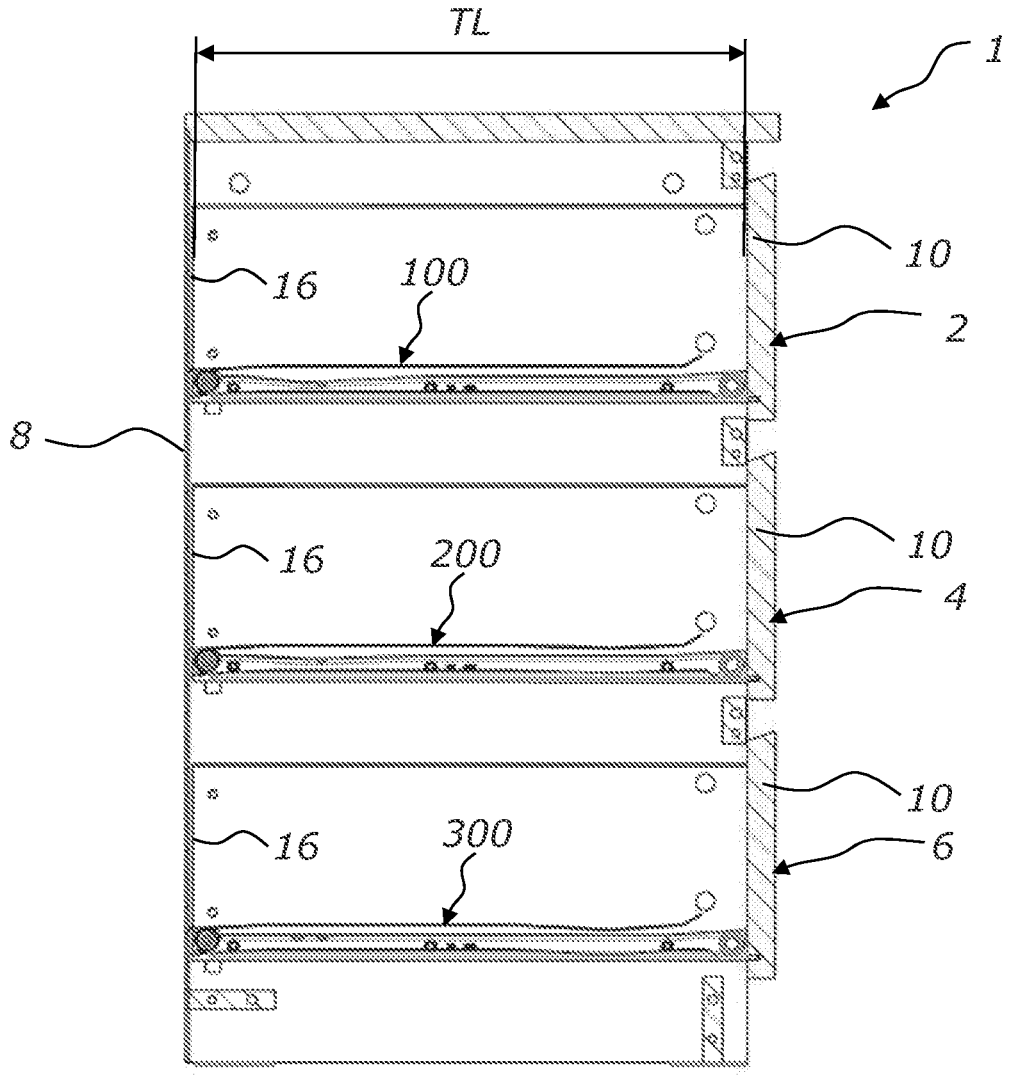
FIG. 3 is a cross-section illustrating the chest of drawers with drawer slides according to three different embodiments.

Hence, each of the drawers 2, 4, 6 of the chest of drawers 1 can assume a static horizontally extended position, as shown in unbroken lines in FIG. 2, in which position a relatively large portion, e.g. 40% of the inner total length TL, see FIG. 3, of the respective drawer 2, 4, 6 is located inside the cabinet 8, making the chest of drawers 1 having low possibility of tipping. Additionally, the drawers 2, 4, 6 of the chest of drawers 1 can also assume a biased non-static extended position, in the embodiment of FIG. 2 the biased non-static extended position has the form of a non-static upwardly tilted extended position, as shown in broken lines in FIG. 2, in which position a relatively small portion, e.g. 25% of the inner total length TL of the respective drawer 2, 4, 6 is located inside the cabinet 8, making items stored in the drawer easily accessible to a person using the chest of drawers 1, however the non-static upwardly tilted extended position can only be maintained as long as a person using the chest of drawers 1 actively pulls the respective drawer 2, 4, 6 outwardly to the non-static upwardly tilted extended position, and as soon as this pulling force is discontinued the drawer will automatically return to the static horizontally extended position, or the drawer may even move further into the cabinet. Thereby, the possibility of the chest of drawers tipping over is substantially reduced.

FIG. 3 illustrates the chest of drawers 1 as seen in cross-section. Each drawer 2, 4, 6 is guided in an essentially linear movement by a set of drawer slides 100, 200, 300, with one drawer slide arranged on each side of the drawer. The chest of drawers 1 illustrated in FIG. 3 is provided with three different sets of drawer slides 100, 200, 300 to illustrate three different embodiments. However, it will be appreciated that in most cases a chest of drawers will in reality contain drawer slides that are of the same embodiment.

Each drawer 2, 4, 6 has an inner total length TL which is the interior length useful for storing goods in the drawer and is measured as the shortest horizontal distance between the front portion 10 and the rear portion 16. Typically the inner total length TL of a drawer could be 20 to 100 cm.

The upper drawer 2 is mounted to the cabinet 8 by means of a drawer slide 100 according to a first embodiment. The central drawer 4 is mounted to the cabinet 8 by means of a drawer slide 200 according to a second embodiment. The lower drawer 6 is mounted to the cabinet 8 by means of a drawer slide 300 according to a third embodiment.

The drawer slide 100 comprises a drawer member which is connected to the drawer 2 and a cabinet member which is connected to the cabinet 8 and the drawer member and the cabinet member can move relative to each other for guiding the drawer 2 in an essentially linear movement relative to the cabinet 8. The construction and function of the drawer slide 100 will now be described in more detail with reference to FIGS. 4*a*-4*b* and 5*a*-5*c*.

Figure 4A:
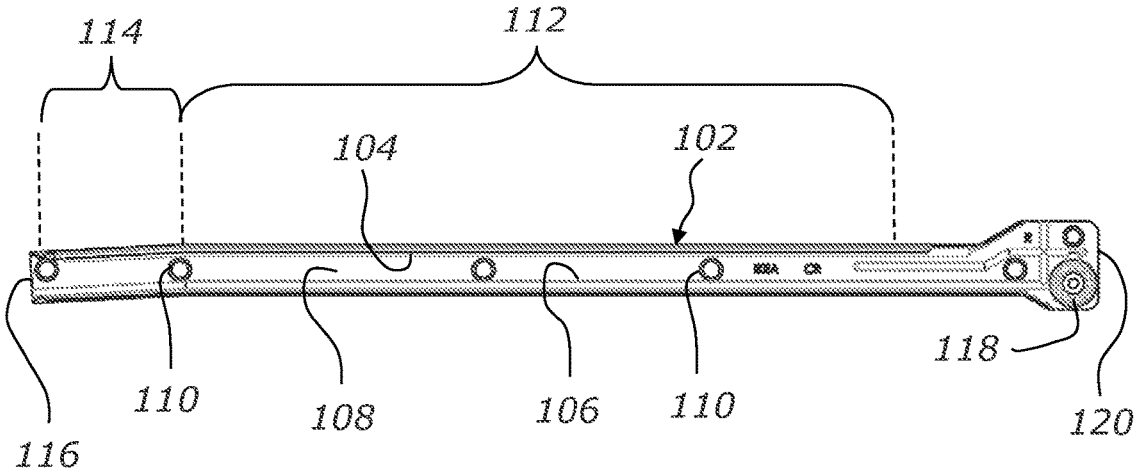
FIGS. 4*a* and 4*b* illustrate a cabinet member and a drawer member, respectively, of a drawer slide according to a first embodiment.
Figure 4B:
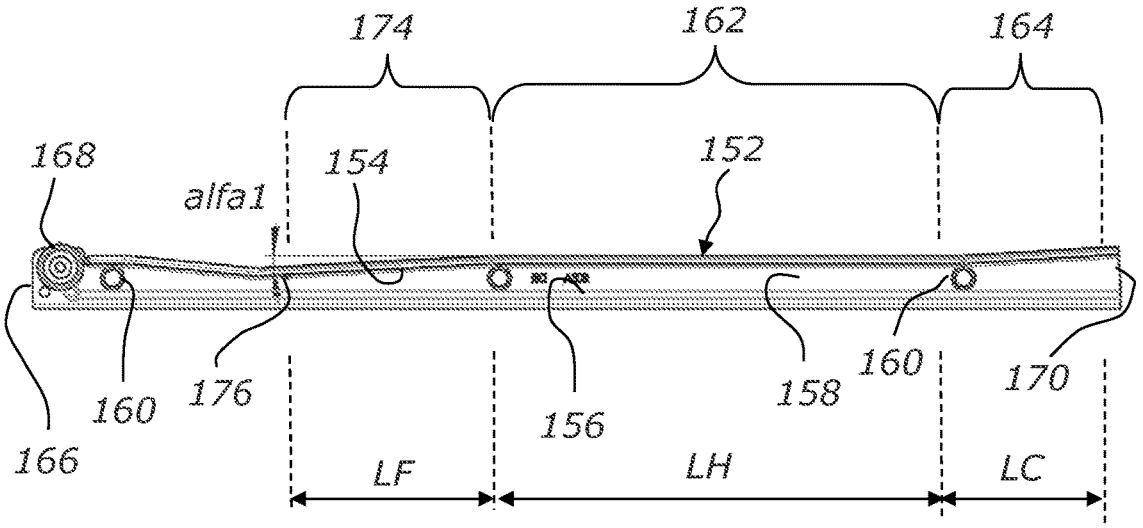

FIG. 4*a* illustrates a cabinet member 102 forming part of the drawer slide 100 illustrated in FIG. 3, and FIG. 4*b* illustrates a drawer member 152 forming part of the same drawer slide 100. The cabinet member 102 is provided with an upper track 104 and a lower track 106 controlling the movement of a drawer member slide member 168 (see FIG. 4*b*) of the drawer member 152, as will be described hereinafter. The two tracks 104, 106 are connected by a web 108 which also contains a number of holes 110 for mounting the cabinet member 102 to an interior wall of the cabinet 8. The cabinet member 102 comprises a static horizontal portion 112 and a final closing portion 114. The static horizontal portion 112 is horizontal and when the slide member 168 of the drawer member 152 travels along this portion (as long as the corresponding portion of the drawer member 152 is also horizontal) the drawer 2 can be moved to any position and it will remain static in this position until a force is applied. The final closing portion 114 is arranged at a first end 116 of the cabinet member 102 and is slightly inclined downwards towards the end 116 of the cabinet member 102. When the slide member 168 of the drawer member 152 is located at the final closing portion 114 there will be a slight downhill effect, which urges the drawer 2 to remain inside the cabinet 8. The cabinet member 102 further comprises a cabinet member slide member 118, which is arranged at a second end 120 of the cabinet member 102. In the present embodiment the cabinet member slide member has the form of a cabinet member wheel 118, which can rotate, and thereby rolls against tracks 154, 156 of the drawer member 152, but it will be appreciated that other embodiments of the cabinet member slide member are also possible, including embodiments where the cabinet member slide member actually slides, according to slide bearing principle, against the tracks 154, 156 of the drawer member 152.

FIG. 4*b* illustrates the drawer member 152 being provided with the upper track 154 and the lower track 156 controlling the movement of a cabinet member slide member 118 (see FIG. 4*a*) of the cabinet member 102. The two tracks 154, 156 are connected by a web 158 containing holes 160 for mounting the drawer member 152 to a side wall of the drawer 2. The drawer member 152 comprises a static horizontal portion 162, a final closing portion 164 and additionally a drawer biasing member in the form of a drawer member drawer front raising portion 174. The static horizontal portion 162 is essentially horizontal and when the static horizontal portion 162 of the drawer member 152 travels along the slide member 118 of the cabinet member 102 the drawer 2 can be left in any position and the drawer will remain static in this position. The final closing portion 164 is arranged at a second end 170 of the drawer member 152 and is slightly inclined upwards towards the end 170 of the drawer member 152. When the slide member 118 of the cabinet member 102 is in the final closing portion 164 there will be the previously described slight downhill effect, which urges the drawer 2 to remain inside the cabinet 8. The drawer member 152 comprises, as previously described, the drawer member slide member 168, which is arranged at a first end 166 of the drawer member 152. In the present embodiment the drawer member slide member has the form of a drawer member wheel 168, which can rotate, and thereby rolls against tracks 104, 106 of the cabinet member 102, but it will be appreciated that other embodiments are also possible, including embodiments where the drawer member slide member actually slides, according to slide bearing principle, against the tracks 104, 106 of the cabinet member 102.

At the drawer front raising portion 174 the upper track 154 is inclined upwards, when looking in a direction from the first end 166 towards the second end 170 of the drawer member 152. In the present embodiment the inclination between the upper track 154 at the drawer front raising portion 174 and the horizontal plane is an angle alfa1 which could, for example, be 0.5 to 8 degrees, more typically 1.5 to 5 degrees. Typically, the drawer front raising portion 174 ends at a mechanical stop 176 which sets a limit for how much the drawer 2 can be pulled out from the cabinet 8.

As will be described hereinafter the drawer front raising portion 174 biases the drawer 2 to a biased non-static extended position in the form of a raised position. The drawer front raising portion 174 typically has a length LF, the static horizontal portion 162 has a length LH and the final closing portion 164 has a length LC. The sum of the lengths LH and LC may, according to one embodiment, correspond to 60% of the inner total length TL of the drawer 2, meaning that the drawer 2 can be extended horizontally to 60% of its inner total length TL, and remain static at that position. The length LF may correspond to about 15% of the inner total length TL of the drawer, meaning that by pulling the drawer 2 outwardly, against the force of gravity caused by the drawer front raising portion 174, the drawer 2 can be extended to 75% of its inner total length TL, however this position is not stable but is a biased non-static extended position, and as soon as the pulling force is released the drawer 2 will automatically, under the force of gravity, return to the horizontally extended position, or even further into the cabinet 8. A drawer 2 which can be extended, due to the construction of the drawer slide 100, to maximum about 65 to 90%, typically to about 75%, of its inner total length TL may be referred to as a "three-quarter" extendable drawer. There are also drawer slide types that have a different construction and that allow a drawer to be extended to its full length, i.e. to about 100% of its inner total length TL, or even slightly more, and these drawers may be referred to as "fully" extendable drawers. The principles described herein illustrate a drawer slide for a "three-quarter" extendable drawer but it will be appreciated that the various embodiments of drawer biasing members described can also be applied to drawer slides for "fully" extendable drawers and for drawers extendable to other degrees as well. According to one embodiment, for a "fully" extendable drawer the sum of the lengths LH and LC (as disclosed in FIG. 4*a*), may correspond to 80% of the inner total length TL of the drawer 2, meaning that the drawer can be extended horizontally to 80% of its inner total length TL, and remain static at that position, and the length LF may correspond to about 20% of the inner total length TL of the drawer, meaning that by pulling the drawer 2 outwardly, against the biasing of the drawer biasing member, the drawer 2 can be extended to 100% of its inner total length TL by pulling it to this position, and as soon as the pulling force is released the drawer 2 will automatically, under the force of gravity, return to the horizontally extended position, or even further into the cabinet.

Figure 5A:
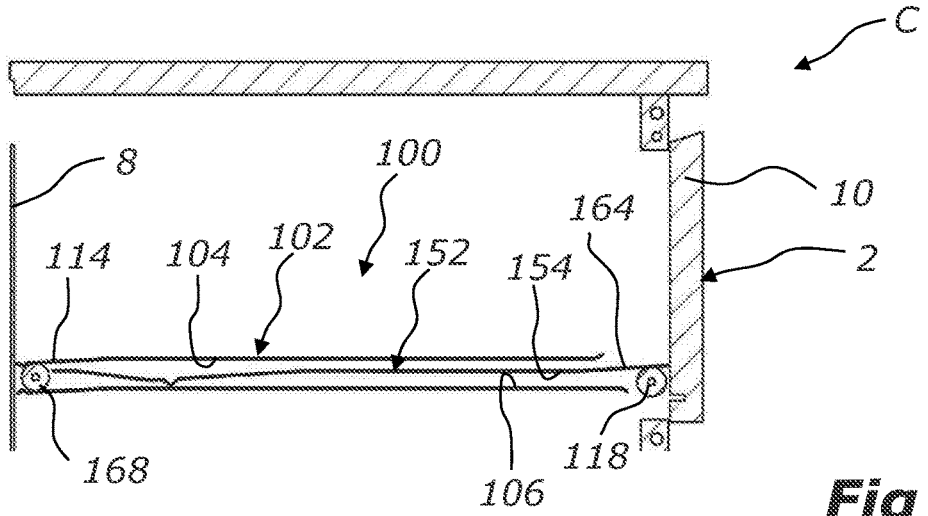
FIG. 5*a*-5*c* illustrate the drawer slide in a cabinet position, a horizontal position and an upwardly tilted extended position.

FIG. 5*a* illustrates, in a schematic cross-sectional manner, and with certain parts hidden for better illustration, the drawer 2 when the drawer slide 100 is in the cabinet position C. In this position the drawer 2 is located inside the cabinet 8. The cabinet member wheel 118 of the cabinet member 102 is in contact with the track 154 in the region of the final closing portion 164 of the drawer member 152, and the drawer member wheel 168 of the drawer member 152 is in contact with at least one of the tracks 104, 106 in the region of the final closing portion 114 of the cabinet member 102. In this position, due to the slightly inclined final closing portions 114, 164, the drawer 2 will remain inside the cabinet 8.

Figure 5B:
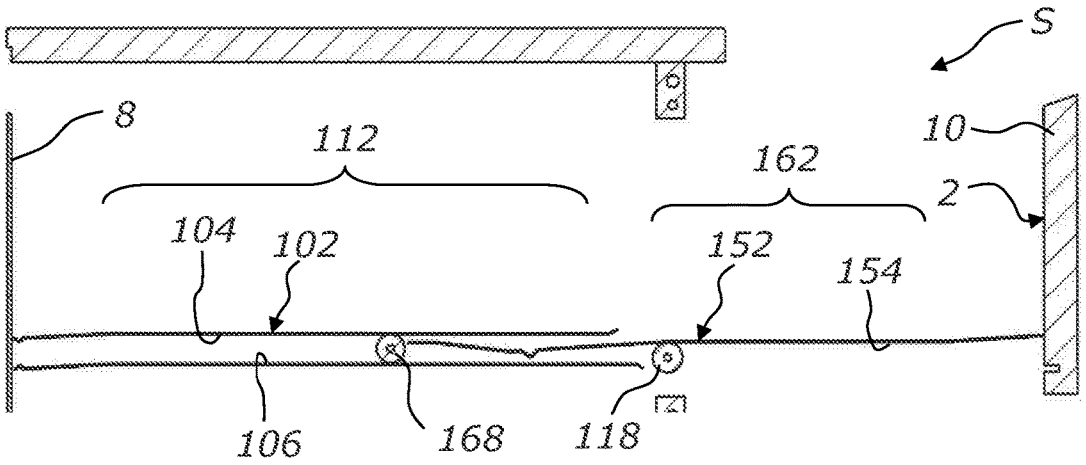

FIG. 5*b* illustrates, in a schematic cross-sectional manner, and with certain parts hidden for better illustration, the drawer 2 when the drawer slide 100 is in the static extended position S. In this position the drawer 2 has been extended from the cabinet 8. The cabinet member wheel 118 of the cabinet member 102 is in contact with the track 154 in the region of the static horizontal portion 162 of the drawer member 152, and the drawer member wheel 168 of the drawer member 152 is in contact with at least one of the tracks 104, 106 in the region of the static horizontal portion 112 of the cabinet member 102. In this position, the drawer 2 is partly extended to a position outside of the cabinet 8. This is a static position, meaning that the drawer 2 can remain in this position until a user decides do push it into the cabinet, or pull it further out of the cabinet.

Figure 5C:
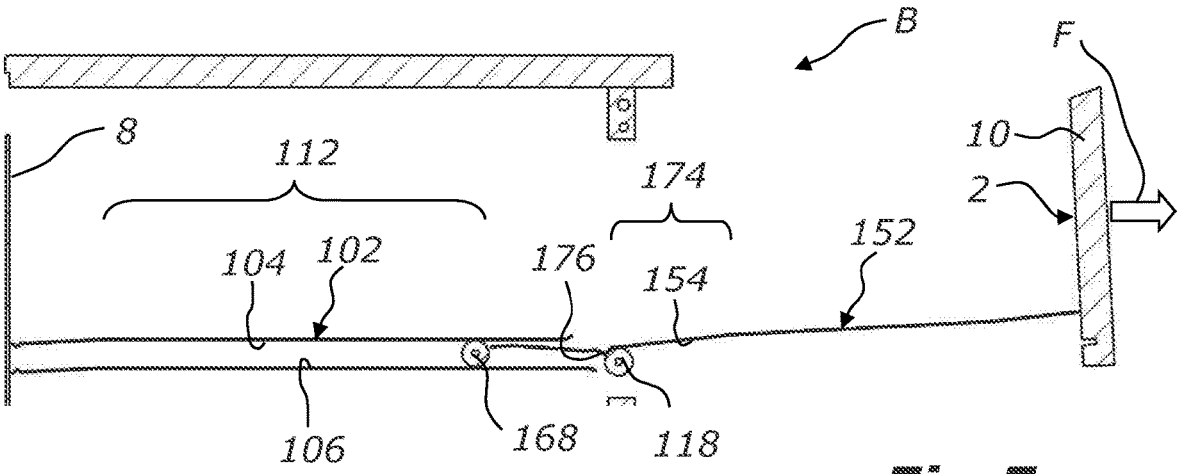

FIG. 5*c* illustrates, in a schematic cross-sectional manner, and with certain parts hidden for better illustration, the drawer 2 when the drawer slide 100 is in the biased non-static extended position in the form of the non-static upwardly tilted extended position B. In this position the drawer 2 has been further extended from the cabinet 8 beyond the static extended position to the non-static upwardly tilted extended position B. The mechanical stop 176 sets a limit for the non-static upwardly tilted extended position B. The cabinet member wheel 118 of the cabinet member 102 is, in this non-static upwardly tilted extended position, in contact with the track 154 in the region of the drawer biasing member, having the form of the drawer front raising portion 174 of the drawer member 152, and the drawer member wheel 168 of the drawer member 152 is in contact with at least one of the tracks 104, 106 in the region of the a static horizontal portion 112 of the cabinet member 102. Thereby, since the track 154 at the drawer front raising portion 174 has an angle to the horizontal plane, the front 10 of the drawer 2 is biased upwardly. This is a non-static position and the drawer 2 will remain in this position only as long as a user applies a pulling force F to the drawer 2. When the user releases the force F the drawer 2 will immediately and automatically move back to the static extended position S illustrated in FIG. 5*b*, or the drawer 2 may even return to the cabinet position C illustrated in FIG. 5*a*, depending on the momentum that the drawer 2 obtains upon release of the force F, as the drawer member 152 makes a "down-hill" run at the contact between the cabinet member wheel 118 and the track 154 in the region of the drawer front raising portion 174.

Figure 6A:
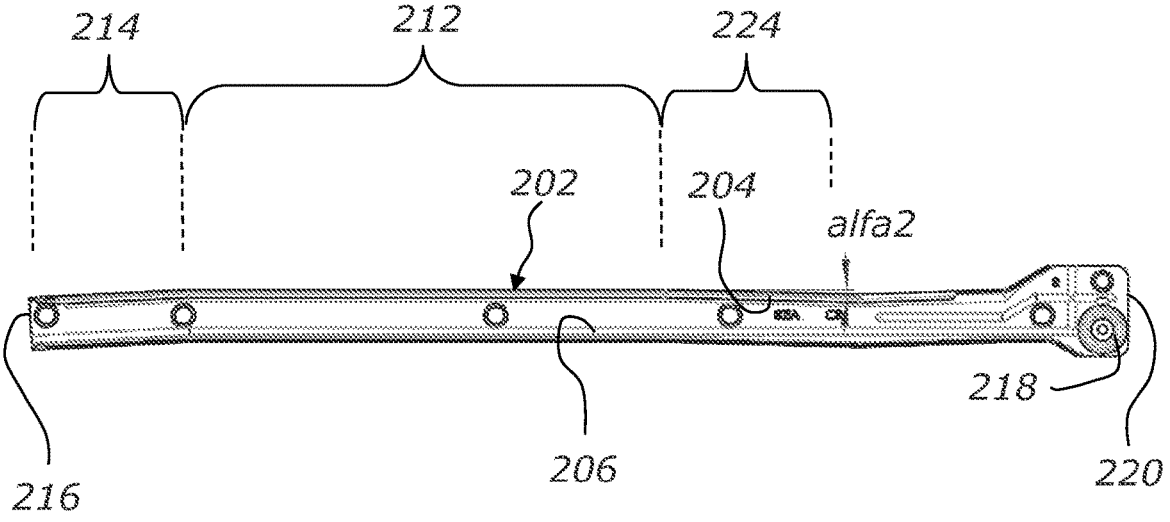
FIGS. 6*a* and 6*b* illustrate a cabinet member and a drawer member, respectively, of a drawer slide according to a second embodiment.
Figure 6B:
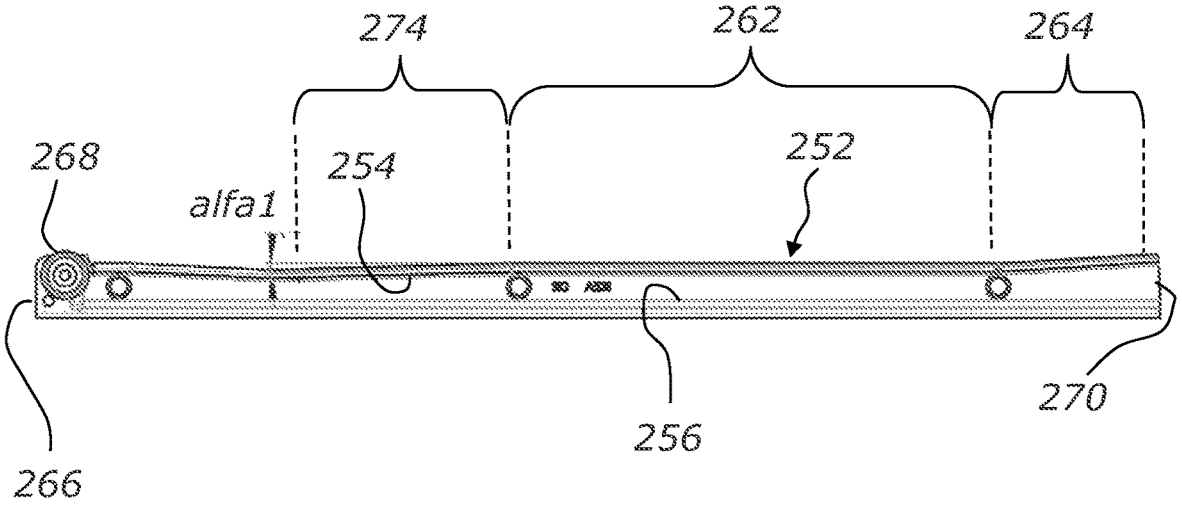

FIG. 6*a* illustrates a cabinet member 202 forming part of the drawer slide 200 illustrated in FIG. 3, and FIG. 6*b* illustrates a drawer member 252 forming part of the same drawer slide 200. The cabinet member 202 is in most aspects similar to the cabinet member 102 described hereinbefore with reference to FIG. 4*a* and therefore mainly the differences will be described.

The cabinet member 202 comprises a static horizontal portion 212, a final closing portion 214 and a drawer biasing member in the form of a cabinet member drawer front raising portion 224. The final closing portion 214 has a similar function and design as the final closing portion 114 described hereinbefore. The static horizontal portion 212 has a similar function and design as the static horizontal portion 112 described hereinbefore, although the static horizontal portion 212 is shorter to make space for the cabinet member drawer front raising portion 224. At the cabinet member drawer front raising portion 224 upper track 204 and lower track 206 controlling the movement of drawer member slide member, e.g. drawer member wheel 268, are inclined downwards, when looking in a direction from the first end 216 towards the second end 220 of the cabinet member 202. In the present embodiment the inclination between the tracks 204, 206 at the drawer front raising portion 224 and the horizontal plane is an angle alfa2 which could, for example, be 0.5 to 8 degrees, typically 0.5 to 4 degrees, more typically 1 to 3 degrees.

FIG. 6*b* illustrates the drawer member 252. The drawer member 252 is in most aspects similar to the drawer member 152 described hereinbefore with reference to FIG. 4*b* and therefore mainly the differences will be described. The drawer member 252 comprises a static horizontal portion 262, a final closing portion 264 and a drawer biasing member in the form of a drawer member drawer front raising portion 274.

At the drawer front raising portion 274 upper track 254 is inclined upwards, when looking in a direction from the first end 266 towards the second end 270 of the drawer member 252. In the present embodiment the inclination between the upper track 254 at the drawer front raising portion 274 and the horizontal plane is an angle alfa1 which could, for example, be 0.5 to 8 degrees, typically 0.5 to 4 degrees, more typically 1 to 3 degrees.

Hence, in comparison to the drawer slide 100 described with reference to FIGS. 4*a*-4*b*, the drawer slide 200 has both a cabinet member drawer front raising portion 224 arranged at the cabinet member 202 and a drawer member drawer front raising portion 274 arranged at the drawer member 252. The sum of the angle alfa1 of the drawer front raising portion 274 and the angle alfa2 of the drawer front raising portion 224 may typically be similar to the angle alfa1 of the drawer front raising portion 174. Thereby, the behaviour of the drawer 4, when pulling the latter from the cabinet 8, will be similar as for the drawer 2, as described hereinbefore.

As will be described hereinafter the drawer front raising portion 274 and the drawer front raising portion 224 together biases the drawer 4 (FIG. 3) to a biased non-static extended position in the form of a non-static upwardly tilted extended position.

Figure 7A:
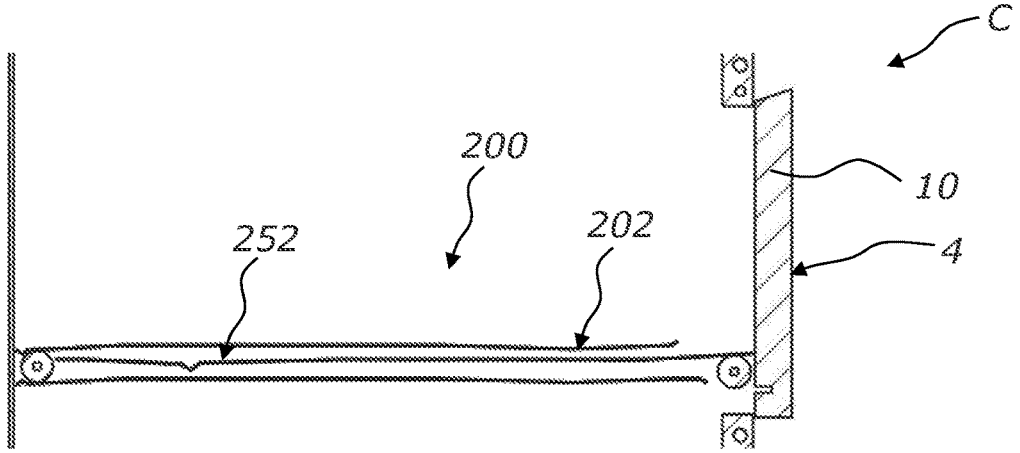
FIG. 7*a*-7*c* illustrate the drawer slide in a cabinet position, a horizontal position and an upwardly tilted extended position.

FIG. 7*a* illustrates the drawer 4 when the drawer slide 200 is in the cabinet position C. In this position the function of the drawer slide 200 is essentially the same as has been described with regard to the drawer slide 100 with reference to FIG. 5*a*.

Figure 7B:
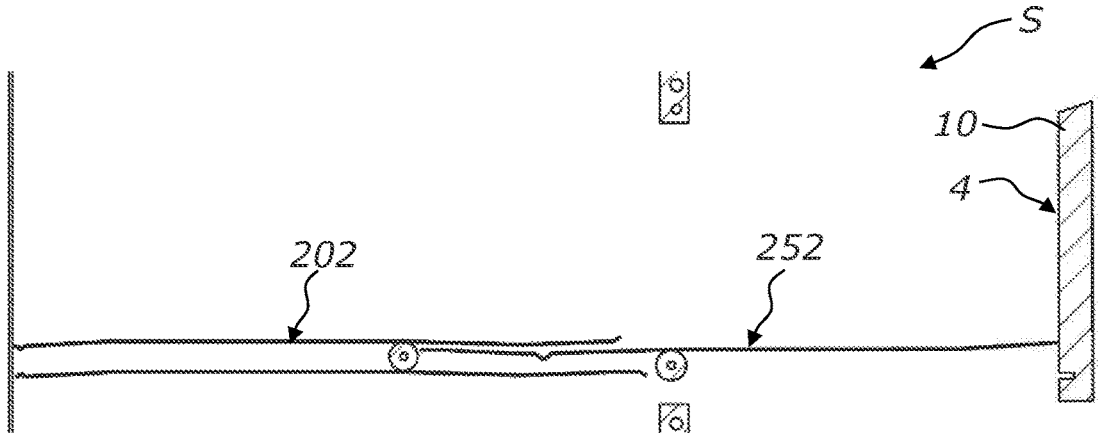

FIG. 7*b* illustrates the drawer 4 when the drawer slide 200 is in the static extended position S. In this position the function of the drawer slide 200 is essentially the same as has been described with regard to the drawer slide 100 with reference to FIG. 5*b*

Figure 7C:
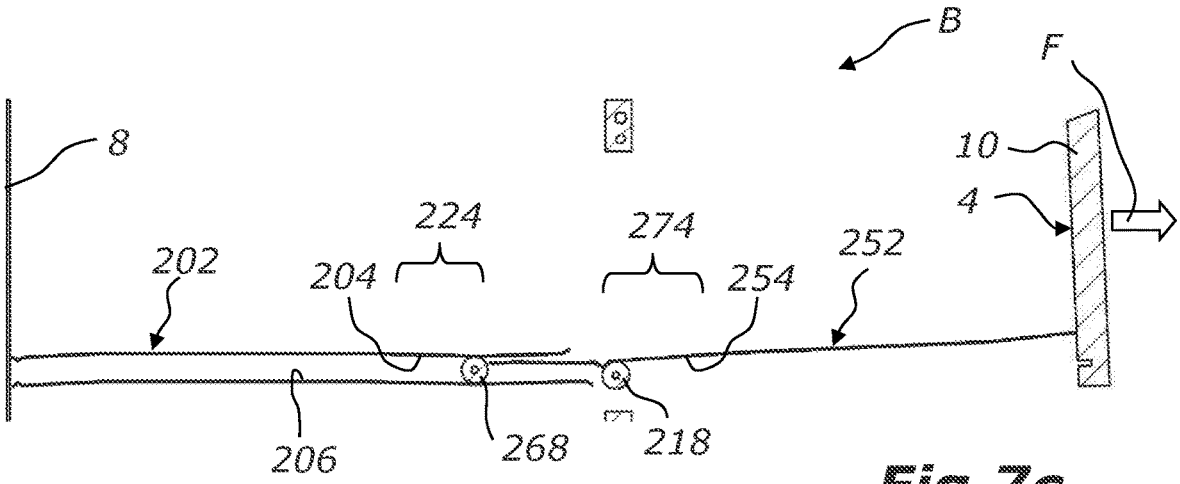

FIG. 7*c* illustrates the drawer 4 when the drawer slide 200 is in the non-static upwardly tilted extended position. In this position the drawer 4 has been further extended from the cabinet 8 beyond the static extended position S of FIG. 7*b* to the non-static upwardly tilted extended position B. Cabinet member wheel 218 of the cabinet member 202 is, in this non-static upwardly tilted extended position B, in contact with the track 254 in the region of the drawer member drawer front raising portion 274 of the drawer member 252, and the drawer member wheel 268 of the drawer member 252 is in contact with at least one of the tracks 204, 206 in the region of the cabinet member drawer front raising portion 224 of the cabinet member 202. Thereby, since the drawer member drawer front raising portion 274 and the cabinet member drawer front raising portion 224 have angles to the horizontal plane, the front 10 of the drawer 4 is biased upwardly. This is a non-static position and the drawer 4 will remain in this position only as long as a user applies a pulling force F to the drawer 4. When the user releases the force F the drawer 4 will immediately and automatically move back to the static extended position S illustrated in FIG. 7*b*, or the drawer 4 may even return to the cabinet position C illustrated in FIG. 7*a*, depending on the momentum that the drawer 4 obtains upon release of the force F, as the drawer member 252 makes a "down-hill" run at the contact between the cabinet member wheel 218 and the track 254 in the region of the drawer member drawer front raising portion 274 and at the contact between the drawer member wheel 268 and the tracks 204, 206 in the region of the cabinet member drawer front raising portion 224.

Figure 8A:
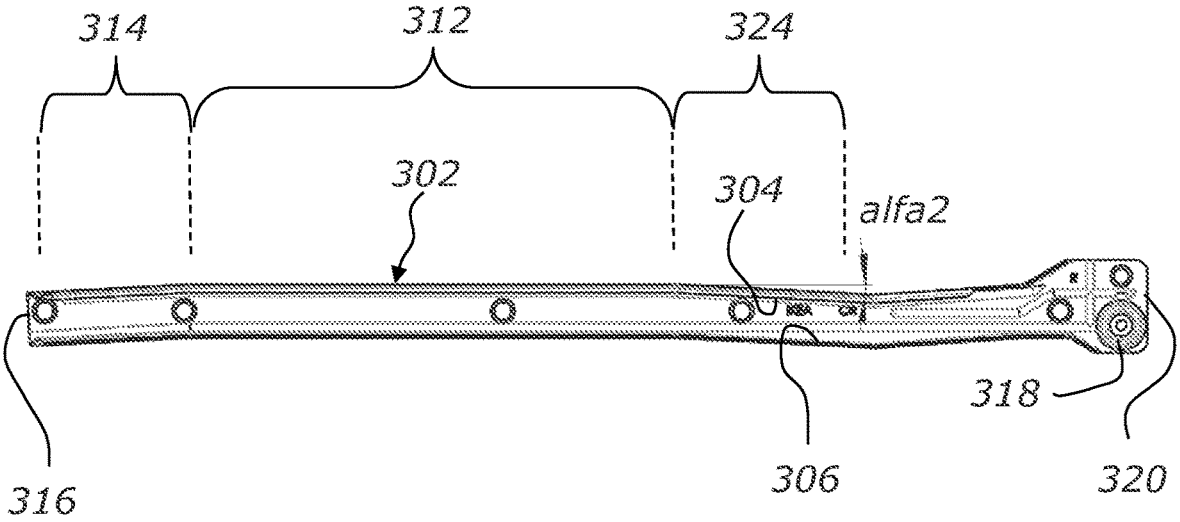
FIGS. 8*a* and 8*b* illustrate a cabinet member and a drawer member, respectively, of a drawer slide according to a third embodiment.
Figure 8B:
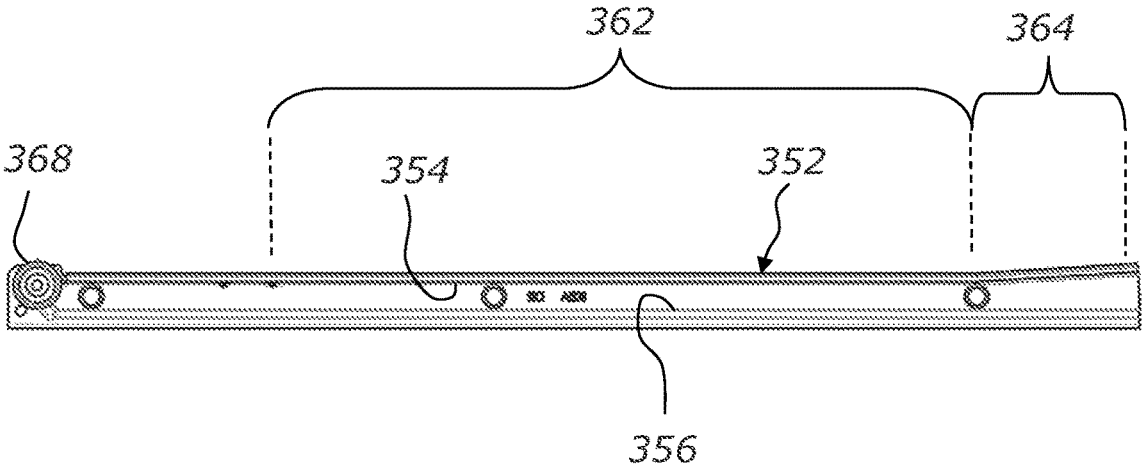

FIG. 8*a* illustrates a cabinet member 302 forming part of the drawer slide 300 illustrated in FIG. 3, and FIG. 8*b* illustrates a drawer member 352 forming part of the same drawer slide 300. The cabinet member 302 is in most aspects similar to the cabinet member 202 described hereinbefore with reference to FIG. 6*a* and therefore mainly the differences will be described.

The cabinet member 302 comprises a static horizontal portion 312, a final closing portion 314 and a drawer biasing member in the form of a cabinet member drawer front raising portion 324. The final closing portion 314 has a similar function and design as the final closing portion 214 described hereinbefore with reference to FIG. 6*a*. The static horizontal portion 312 has a similar function and design as the static horizontal portion 212 described hereinbefore with reference to FIG. 6*a*, and the cabinet member drawer front raising portion 324 has a similar design and function as the cabinet member drawer front raising portion 224 also described hereinbefore with reference to FIG. 6*a*. Hence, in the cabinet member drawer front raising portion 324 the upper track 304 and lower track 306 controlling the movement of drawer member slide member, e.g. drawer member wheel 368, are inclined downwards, when looking in a direction from the first end 316 towards the second end 320 of the cabinet member 302. In the present embodiment the inclination between the tracks 304, 306 at the drawer front raising portion 324 and the horizontal plane is an angle alfa2 which could, for example, be 0.5 to 8 degrees, more typically 1.5 to 5 degrees. As will be described in more detail hereinafter, there is in the drawer member 352 of the drawer slide 300 no drawer member drawer front raising portion as in the drawer slide 200 and for this reason the angle alfa2 is larger in the drawer slide 300 compared to the drawer slide 200.

FIG. 8*b* illustrates the drawer member 352. The drawer member 352 is in most aspects similar to the drawer member 252 described hereinbefore with reference to FIG. 6*b* and therefore mainly the differences will be described. The drawer member 352 comprises a static horizontal portion 362, and a final closing portion 364. However, in the drawer member 352 there is no drawer member drawer front raising portion, but instead the static horizontal portion 362 has a longer extension along which upper and lower tracks 354, 356 are horizontal.

Hence, in comparison to the drawer slide 200 described with reference to FIGS. 6*a*-6*b*, the drawer slide 300 has a cabinet member drawer front raising portion 324 arranged at the cabinet member 302 but no drawer member drawer front raising portion arranged at the drawer member 352.

As will be described hereinafter the drawer front raising portion 324 biases the drawer 6 (FIG. 3) to a non-static biased position in the form of a non-static upwardly tilted extended position.

Figure 9A:
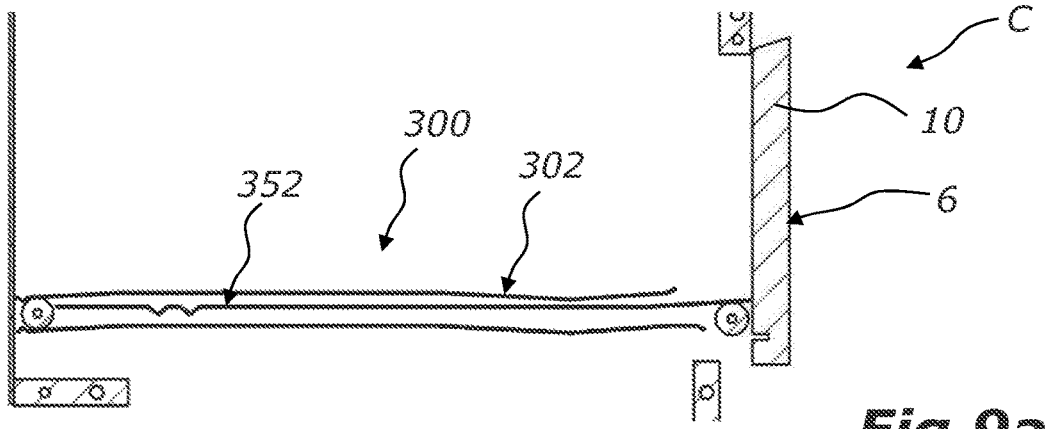
FIG. 9*a*-9*c* illustrate the drawer slide in a cabinet position, a horizontal position and an upwardly tilted extended position.

FIG. 9*a* illustrates the drawer 6 when the drawer slide 300 is in the cabinet position C. In this position the function of the drawer slide 300 is essentially the same as has been described with regard to the drawer slide 100 with reference to FIG. 5*a*.

Figure 9B:
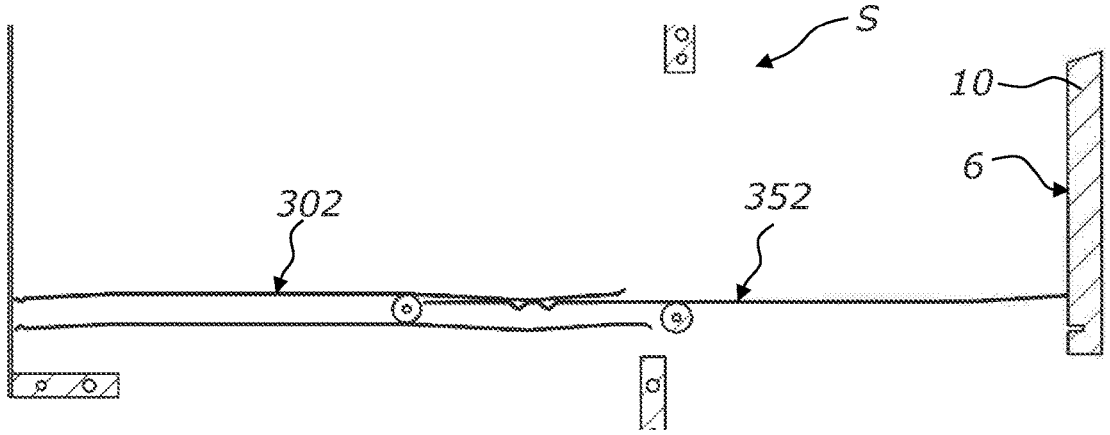

FIG. 9*b* illustrates the drawer 6 when the drawer slide 300 is in the static horizontally extended position S. In this position the function of the drawer slide 300 is essentially the same as has been described with regard to the drawer slide 100 with reference to FIG. 5*b*.

Figure 9C:
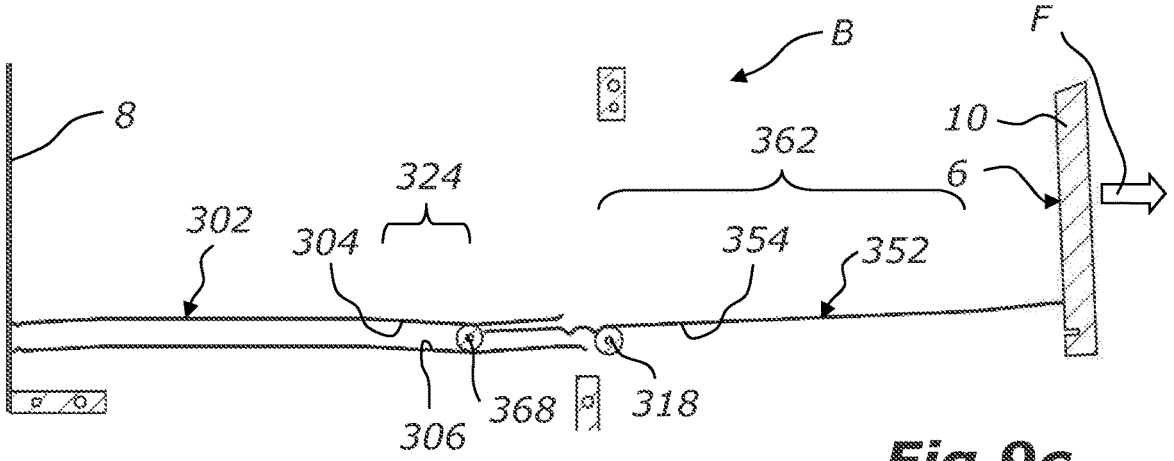

FIG. 9*c* illustrates the drawer 6 when the drawer slide 300 is in the non-static upwardly tilted extended position B. In this position the drawer 6 has been further extended from the cabinet 8 beyond the static horizontally extended position of FIG. 9*b* to the non-static upwardly tilted extended position B. Cabinet member wheel 318 of the cabinet member 302 is, in this non-static upwardly tilted extended position, in contact with the track 354 in the region of the static horizontal portion 362 of the drawer member 352, and the drawer member wheel 368 of the drawer member 352 is in contact with at least one of the tracks 304, 306 in the region of the cabinet member drawer front raising portion 324 of the cabinet member 302. Thereby, since the tracks 304, 306 have, in the cabinet member drawer front raising portion 324, an angle alfa2 to the horizontal plane, the front 10 of the drawer 6 is biased upwardly. This is a non-static position and the drawer 6 will remain in this position only as long as a user applies a pulling force F to the drawer 6. When the user releases the force F the drawer 6 will immediately and automatically move back to the static horizontally extended position S illustrated in FIG. 9*b*, or the drawer 6 may even return to the cabinet position C illustrated in FIG. 9*a*, depending on the momentum that the drawer 6 obtains upon release of the force F, as the drawer member 352 makes a "down-hill" run at the contact between the drawer member wheel 368 and the tracks 304, 306 at the cabinet member drawer front raising portion 324.

Figure 10A:
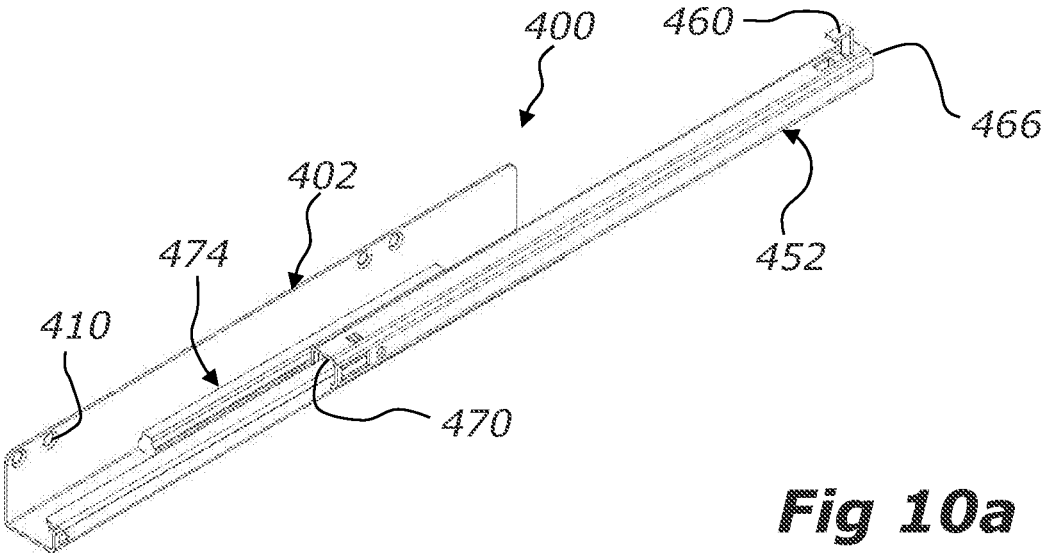
FIGS. 10*a* and 10*b* illustrate a drawer slide according to a fourth embodiment.
Figure 10B:
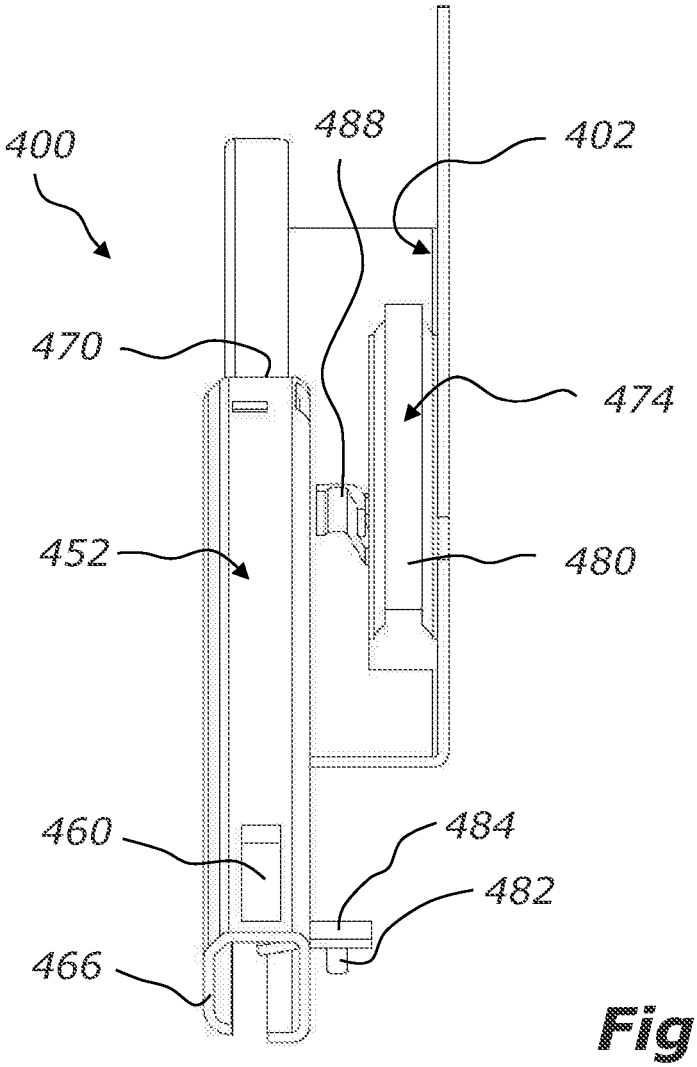

FIG. 10*a* illustrates a drawer slide 400 according to fourth embodiment in perspective view, and FIG. 10*b* illustrates the same drawer slide 400 as seen in a longitudinal view. The drawer slide 400 comprises a cabinet member 402 and drawer member 452. The cabinet member 402 and the drawer member 452 can slide relative to each other by means of, e.g., roller bearings and/or ball bearings and/or glide bearings as is per se known for use in drawer slides. The cabinet member 402 is provided with a number of holes 410 for mounting the cabinet member 402 to an interior wall of a cabinet 408 (shown in FIGS. 12*a*-12*c*) and the drawer member 452 comprises a mounting hook 460 arranged at a first end 466 of the drawer member 452 and used for mounting the drawer member 452 to a drawer 406 (shown in FIGS. 12*a*-12*c*). The first end 466 of the drawer member 452 is arranged opposite to a second end 470 which is arranged to be closer to an opening of the cabinet 408.

Furthermore, the drawer slide 400 comprises a drawer biasing member in the form of a spring arrangement 474. The spring arrangement 474 is best shown in FIG. 10*b* and comprises a spring housing 480 arranged at the cabinet member 402 and a spring biasing member in the form of a spring biasing pin 482 arranged at the drawer member 452. The spring biasing pin 482 is fixedly mounted to the drawer member 452 by means of a pin bracket 484.

Figure 11A:
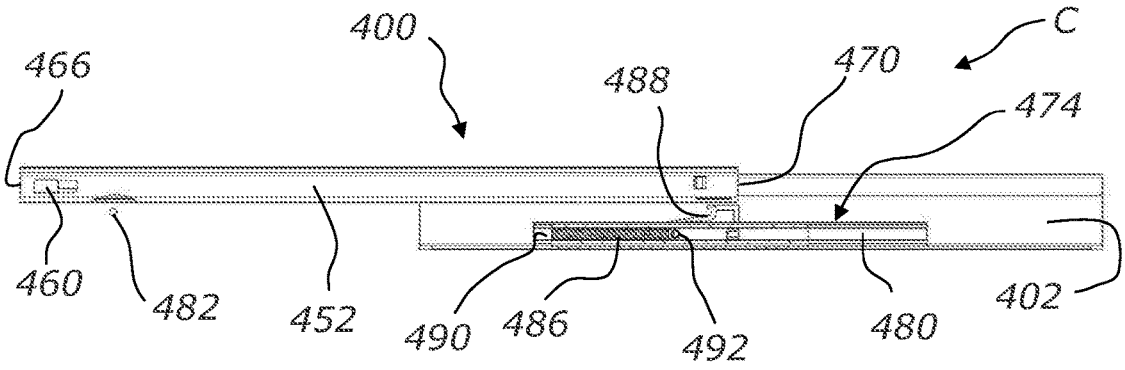
FIG. 11*a*-11*c* illustrate the drawer slide in a cabinet position, a static extended position and a biased non-static extended position, as seen from the top of the drawer slide.
Figure 11B:
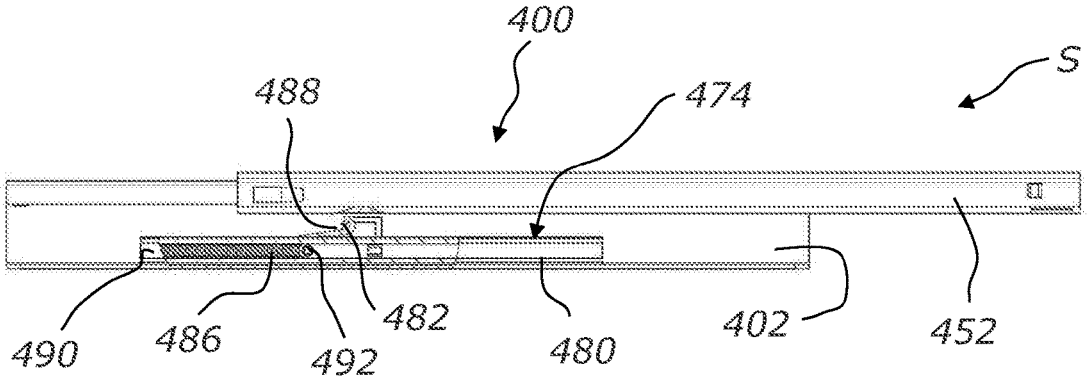
Figure 11C:
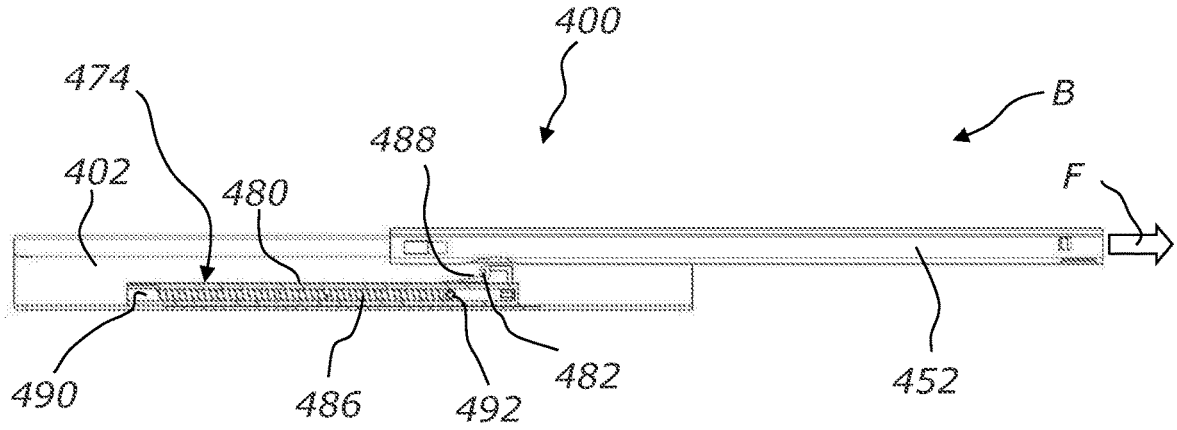

The spring housing 480 houses a spring 486, which is hidden in FIG. 10*b* but which is shown in FIGS. 11*a*-*c*. Returning to FIG. 10*b*, the spring housing 480 further comprises a spring tensioning member in the form of a spring hook 488 which is connected to one end of the spring 486 and which is movable relative to the housing 480. The spring hook 488 is arranged for co-operating with the spring biasing pin 482 so that the spring biasing pin 482 can produce a tension in the spring.

As will be described hereinafter the drawer biasing member 474 is biased when the drawer 406 is pulled to a non-static position in the form of a spring biased position. The spring arrangement 474 is, according to one embodiment, arranged in such a position on the cabinet member 402 and the drawer member 452 that the drawer 406 can be extended horizontally to 60% of its length, and remain static at that position. If the drawer 406 is extended further from the cabinet 408 the spring biasing pin 482 will come into contact with the spring hook 488 and thereby the spring 486 starts to become biased. By pulling the drawer 408 further outwardly, against the force of the spring 486, the drawer 406 can be extended to, e.g. 75% of its total length, however this position is not stable but is a non-static position, and as soon as the pulling force is released the drawer 406 will automatically, under the force of the spring 486, return to the static horizontally extended position, or even further into the cabinet 408.

FIG. 11*a* illustrates, in top view and partly in section to illustrate some interior parts, the drawer slide 400 in the cabinet position C. The spring 486 is connected to the housing 480, and thereby fixedly connected to the cabinet member 402, at a first end 490, and is connected to the spring hook 488 at a second end 492. In the cabinet position C the spring biasing pin 482, which is fixedly connected to the drawer member 452 by means of the bracket 484 as shown in FIG. 10*b*, is out of contact with the spring hook 488, so there is no biasing of the spring 486.

FIG. 11*b* illustrates the drawer slide 400 in the static horizontally extended position S. In this position the spring biasing pin 482 has just come into contact with the spring hook 488, but has not yet started to bias the spring 486. This is a static position, meaning that the drawer slide 400 can remain in this position until a user decides do push the drawer into the cabinet, or pull it further out of the cabinet.

FIG. 11*c* illustrates the drawer slide 400 in the biased non-static extended position in the form of a non-static spring biased extended position B. In this position the spring biasing pin 482 has moved the spring hook 488, to the right as seen in FIG. 11*c*, and has biased the spring 486 from its normal relaxed state, meaning that the spring 486 is now extended to a longer length than the length at which the spring is relaxed, thereby spring energy has been charged to the spring 486. This is a non-static position, meaning that the drawer slide 400 can remain in this position only as long as a user actively pulls the drawer slide 400 to this position, illustrated as a pulling force F, and as soon as the user stops pulling the drawer slide 400 to this position the drawer slide 400 will automatically, caused by the spring energy charged into the spring 486, return to the static horizontally extended position S or even to the cabinet position C.

Figure 12A:
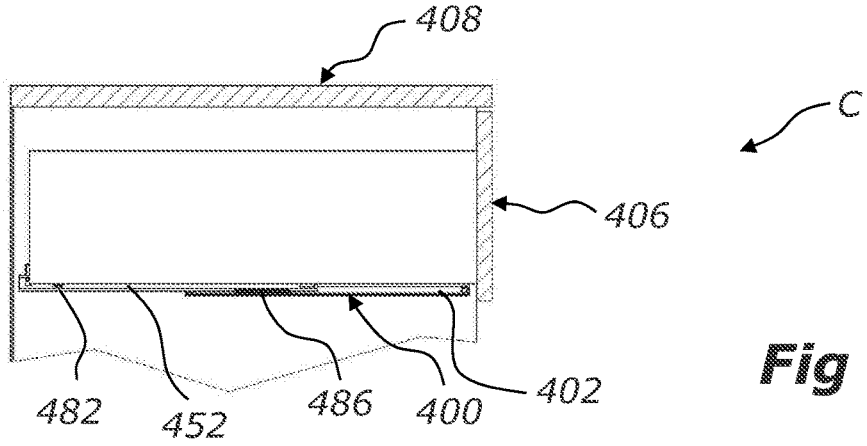
FIG. 12*a*-12*c* illustrate the drawer slide in a cabinet position, a static extended position and a biased non-static extended position, as seen mounted inside a cabinet.
Figure 12B:
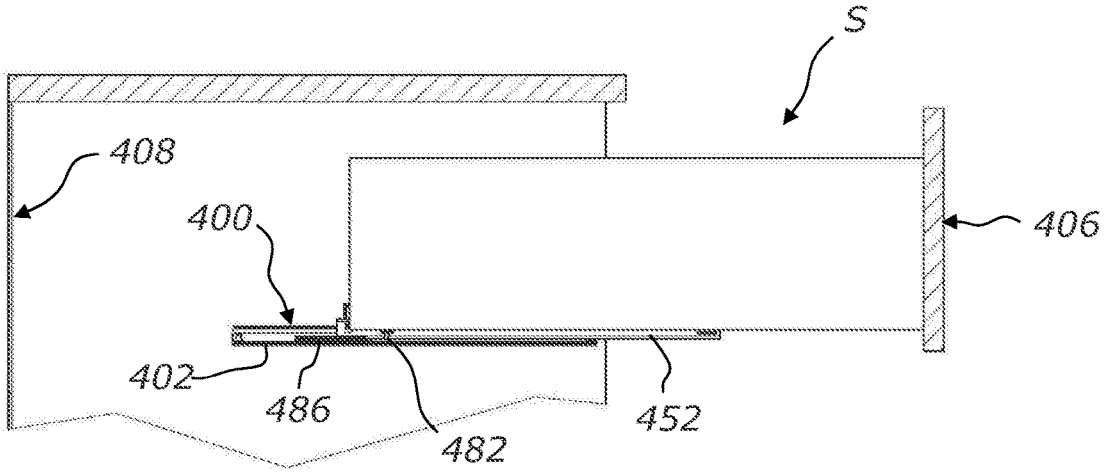
Figure 12C:
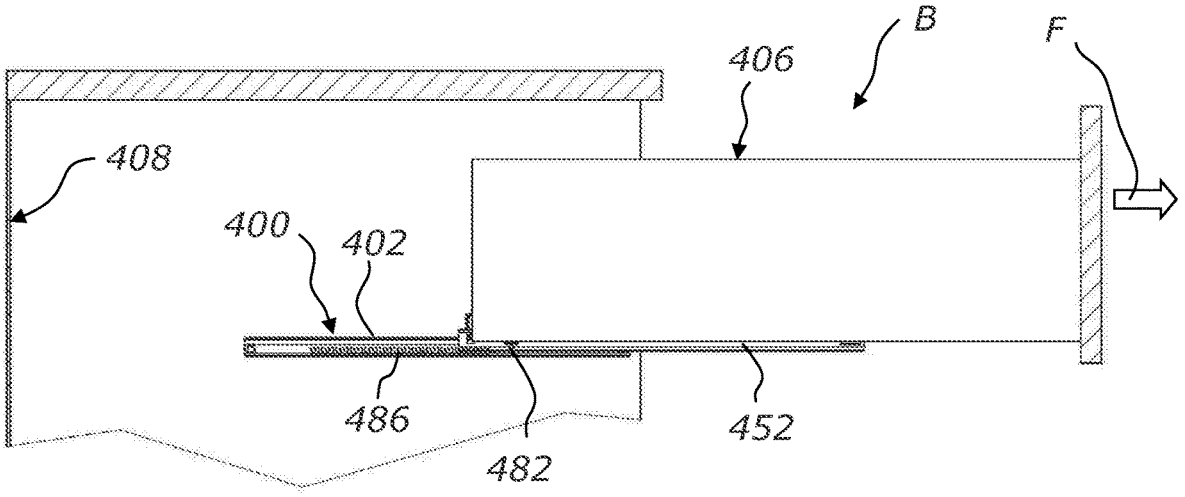

FIGS. 12*a* to 12*c* illustrate the same three positions of the drawer slide 400 as illustrated in FIGS. 11*a* to 11*c*, but as seen in a side view and also with the drawer 406 and cabinet 408 shown.

Hence, FIG. 12*a* illustrates the drawer slide 400 and the drawer 406 in the cabinet position C. The spring 486 is not biased in this position.

FIG. 12*b* illustrates the drawer slide 400 and the drawer 406 in the static horizontally extended position S. The spring biasing pin 482 has just come into contact with the spring hook 488 (best shown in FIG. 10*b*), but has not yet started to bias the spring 486. This is a static position, meaning that the drawer 406 can remain in this position until a user decides do push the drawer 406 into the cabinet 408, or pull it further out of the cabinet.

FIG. 12*c* illustrates the drawer slide 400 and the drawer 406 in the non-static spring biased extended position B. In this position the spring biasing pin 482 has moved the spring hook 488, to the right as seen in FIG. 12*c*, and has biased the spring 486 from its normal relaxed state, thereby spring energy has been charged to the spring 486. This is a non-static position, meaning that the drawer 406 can remain in this position only as long as a user actively pulls the drawer 406 to this position applying a pulling force F, and as soon as the user stops pulling the drawer 406 to this position the drawer slide 400 and the drawer 406 will automatically return to the static horizontally extended position S or even to the cabinet position C.

Figure 13A:
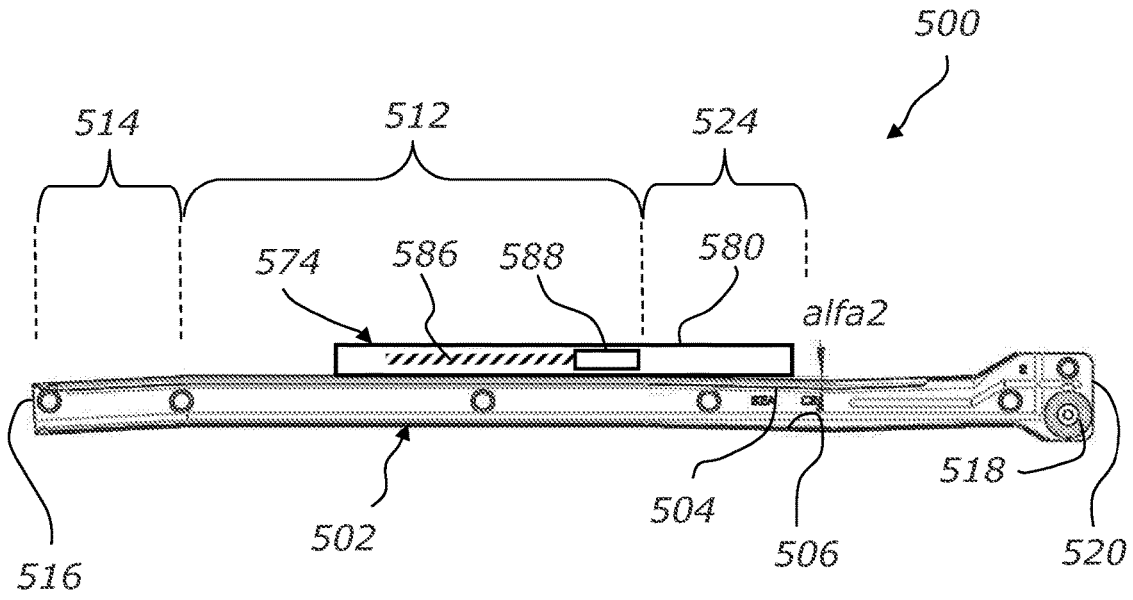
FIGS. 13*a* and 13*b* illustrate a cabinet member and a drawer member, respectively, of a drawer slide according to a fifth embodiment.
Figure 13B:
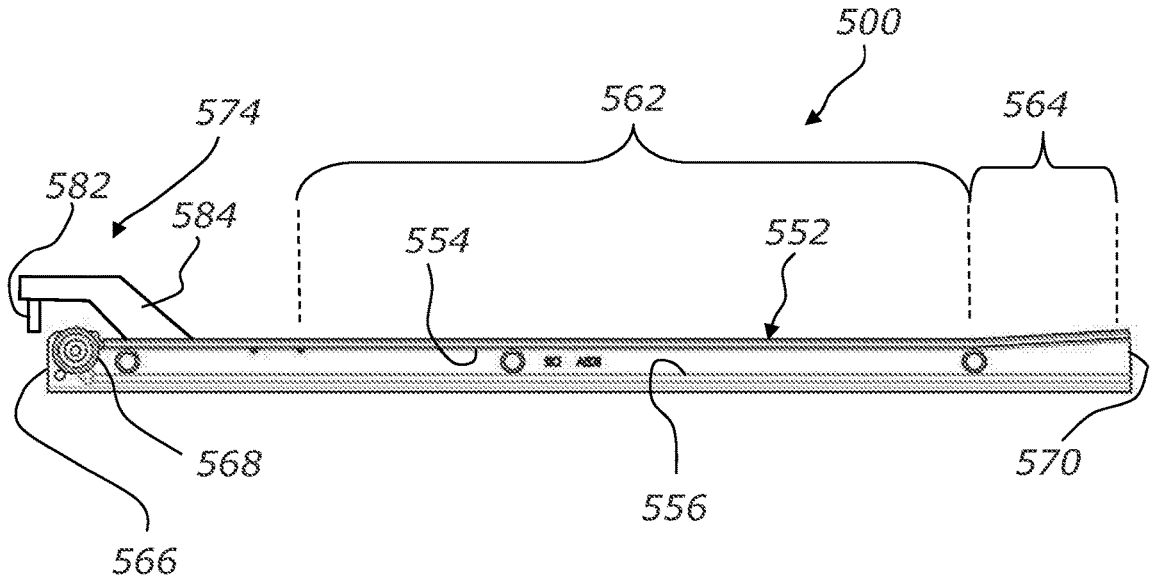

FIG. 13*a* illustrates a cabinet member 502 forming part of a drawer slide 500 that also includes a drawer member 552 illustrated in FIG. 13*b*. The cabinet member 502 is in most aspects similar to the cabinet member 202 described hereinbefore with reference to FIG. 6*a* and therefore mainly the differences will be described.

The cabinet member 502 comprises a static horizontal portion 512, a final closing portion 514 and a first drawer biasing member in the form of a cabinet member drawer front raising portion 524. The final closing portion 514 has a similar function and design as the final closing portion 214 described hereinbefore, and the static horizontal portion 512 has a similar function and design as the static horizontal portion 212 described hereinbefore. The cabinet member drawer front raising portion 524, has, similar to the front raising portion 224, an upper track 504 and a lower track 506 that are inclined downwardly, when looking in a direction from the first end 516 towards the second end 520, an angle alfa2 to the horizontal plane, and this angle alfa2 may, for example, be 0.5 to 8 degrees, typically 0.5 to 4 degrees, more typically 1 to 3 degrees.

In addition the drawer slide 500 comprises a second drawer biasing member in the form of a spring arrangement 574. The spring arrangement 574 is similar to the spring arrangement 474 described hereinbefore with reference to FIGS. 10*a*, 10*b* and FIGS. 11*a* to 11*c* and comprises a spring housing 580 which is mounted to the cabinet member 502. The spring housing 580 houses a spring member in the form of a spring 586, which may be similar to the spring 486 described hereinbefore. The spring housing 580 further comprises a spring tensioning member in the form of a spring hook 588 which is connected to one end of the spring 586 and which is movable relative to the housing 580 for tensioning the spring 586 in a manner similar to that described hereinbefore concerning the hook 488.

FIG. 13*b* illustrates the drawer member 552 which is in most aspects similar to the drawer member 352 described hereinbefore with reference to FIG. 8*b*. Hence, the drawer member 552 comprises a static horizontal portion 562 similar to the static horizontal portion 362 and a final closing portion 564 similar to the final closing portion 364. The spring arrangement 574 comprises a spring biasing pin 582 which is fixedly mounted to the drawer member 552 by means of a pin bracket 584 at a first end 566 of the drawer member 552, the first end 566 being located adjacent a drawer member wheel 568 and opposite a second end 570. The spring arrangement 574 works according to a similar principle as the spring arrangement 474. Hence, when a drawer connected to a cabinet by means of the drawer slide 500 is pulled from a static horizontally extended position S towards a biased non-static extended position B the spring biasing pin 582 connects to the hook 588 and starts biasing the spring 586, which in this embodiment means that the hook 588 extends the spring 586.

As soon as a user stops pulling the drawer slide 500 to the biased non-static extended position B the drawer slide 500 will automatically return to the static horizontally extended position S or even to the cabinet position C, caused by the combined effect of: i) the drawer member 552 making a "down-hill" run at the contact between the drawer member wheel 568 and the tracks 504, 506 at the cabinet member drawer front raising portion 524, and ii) the spring energy charged into the spring 586 of the spring arrangement 574 acting on the drawer member 552 via the hook 588 and the pin 582.

Hence, as has been described hereinabove there are different ways of designing a drawer slide 100, 200, 300, 400, 500 enabling for a drawer to be extended to a biased non-static extended position, arranged beyond a static horizontally extended position, from which biased non-static extended position the drawer will automatically return to the static horizontally extended position, or even to a cabinet position, as soon as a pulling force ceases to act on the drawer. In the drawer slides 100, 200, 300 the biasing force, i.e. the pulling force, vertically raises the drawer above its normal vertical position, and as soon as the pulling force is released the drawer will automatically return to the static horizontally extended position, or even to the cabinet position, under action of the force of gravity. In the drawer slide 400 there is spring energy generated when the drawer is pulled beyond a static horizontally extended position to a biased non-static extended position, and as soon as the pulling force is released the drawer will automatically return to the static horizontally extended position, or even to the cabinet position, under action of the force of the spring. In the drawer slide 500 there is a combination of force of gravity, as in the drawer slides 100, 200, 300, and force of a spring, as in the drawer slide 400, that makes a drawer return from a biased non-static extended position to the static horizontally extended position when a pulling force is released.

It will be appreciated that numerous variants of the above described embodiments are possible within the scope of the appended claims.

For example, other forces may also be applied to achieve the desired function. A spring energy could, as alternative to a mechanical spring, be obtained by compressing air in an air cylinder as the drawer is extended beyond a static horizontally extended position to a biased non-static extended position. Other alternatives include an electrical motor or a magnetic force induced by a permanent magnet or an electrical magnet and activated at the biased non-static extended position B of the drawer and acting to return the drawer to the static horizontally extended position S as soon as a pulling force is released.

Hereinbefore it has been described that at the static extended position S e.g. 40% of the inner total length TL of the respective drawer 2, 4, 6 is located inside the cabinet 8, and that in the biased non-static extended position B, e.g. 25% of the inner total length TL of the respective drawer 2, 4, 6 is located inside the cabinet 8. These numbers, 40% and 25% respectably, may of course vary depending on, e.g., the total weight of the chest of drawers, which types of drawer slides that are used, etc. For instance in one embodiment the drawer could be fully extending from the cabinet in the biased non-static extended position B.

Hereinbefore it has been described that the cabinet and drawer combination has the form of a chest of drawers 1. It will be appreciated that the drawer slide is useful also for other cabinet and drawer combinations, such as benches comprising a built-in drawer, tables comprising a built-in drawer, book shelves comprising built-in drawers, wardrobes comprising built in drawers etc.

To summarize, a drawer slide 100, 200, 300, 400, 500 for guiding a drawer 2, 4, 6, 406 in an essentially linear movement as the drawer 2, 4, 6, 406 is pulled out from a cabinet 8, 408 to a static extended position S comprises at least one drawer biasing member 174, 224, 274, 324, 474, 524, 574 arranged to bias the drawer 2, 4, 6, 406 in a direction towards the cabinet 8, 408 upon pulling the drawer 2, 4, 6, 406 further away from the cabinet 8, 408 beyond the static extended position S to a biased non-static extended position B.

The invention claimed is:

1. A drawer slide for guiding a drawer in a cabinet in an essentially linear movement as the drawer is pulled out from the cabinet to a static extended position, wherein the drawer slide comprises:

(a) a drawer member configured for extending along a right side or a left side of the drawer, wherein the drawer has a front side and a back side;

(b) a cabinet member configured for extending along the cabinet, wherein the drawer member is configured to move relative to the cabinet member for guiding the drawer as the drawer is pulled out from the cabinet to the static extended position; and (c) drawer biasing means for biasing the drawer in a direction towards the cabinet only after pulling the drawer further away from the cabinet beyond the static extended position to a biased non-static extended position, wherein the drawer slide is constructed such that the drawer is extendable further away from the cabinet beyond the static extended position to the biased non-static extended position.

2. The drawer slide according to claim 1, wherein the drawer biasing means is for automatically moving the drawer from the biased non-static extended position towards the static extended position when an external force pulling the drawer towards the biased non-static extended position has been discontinued.

3. The drawer slide according to claim 1, wherein the drawer biasing means is a mechanical biasing member arranged for functioning in the absence of electrical power.

4. The drawer slide according to claim 1, wherein the drawer biasing means is for generating potential energy as the drawer is pulled from the static extended position towards the biased non-static extended position.

5. The drawer slide according to claim 4, wherein the drawer biasing means is for generating a potential energy by at least one of: i) raising a portion of the drawer in a vertical direction, and ii) extending or compressing a spring member.

6. The drawer slide according to claim 1, wherein the cabinet member is arranged for being mounted to the cabinet and the drawer member is arranged for being mounted to the drawer; and wherein the drawer member is movable relative to the cabinet net member in a horizontal direction to allow the drawer to be pulled out of the cabinet.

7. The drawer slide according to claim 6, wherein at least one of the cabinet member and the drawer member is provided with the drawer biasing means; and wherein the other of the cabinet member and the drawer member cooperates with the drawer biasing means when the other of the cabinet member and the drawer member is in a position corresponding to the drawer being extended beyond the static extended position.

8. The drawer slide according to claim 6, wherein the drawer biasing means includes at least one drawer front raising portion arranged for moving a front of the drawer at least partly vertically upwards upon pulling the drawer outwardly beyond the static extended position.

9. The drawer slide according to claim 8, wherein the at least one drawer front raising portion comprises a portion of a track of at least one of the cabinet member and the drawer member being inclined relative to the horizontal plane, the track being in sliding contact with a slide member arranged on the other of the cabinet member and the drawer member.

10. The drawer slide according to claim 9, wherein a portion of a track of the cabinet member is inclined relative to the horizontal plane.

11. The drawer slide according to claim 9, wherein a portion of a track of the drawer member is inclined relative to the horizontal plane.

12. The drawer slide according to claim 9, wherein a portion of a track of the drawer member is inclined relative to the horizontal plane an angle (alfa1) of 0.5-8 degrees.

13. The drawer slide according to claim 8, wherein the drawer biasing means is for inclining the drawer to raise a front portion of the drawer relative to a rear portion of the drawer upon pulling the drawer outwardly beyond the static extended position.

14. The drawer slide according to claim 1, wherein the drawer biasing means comprises a spring arrangement arranged to bias the drawer in a direction towards the cabinet upon pulling the drawer further away from the cabinet beyond the static extended position to the biased non-static extended position.

15. The drawer slide according to claim 14, wherein the drawer slide is arranged for being mounted to the cabinet and the drawer member is arranged for being mounted to the drawer;

wherein the drawer member is movable relative to the cabinet member in a horizontal direction to allow the drawer to be pulled out of the cabinet; and wherein the spring arrangement comprises a spring biasing member arranged on one of the cabinet member and the drawer member, the spring biasing member being arranged for co-operating with a spring member and for generating spring energy in the spring member upon pulling the drawer further away from the cabinet beyond the static extended position.

16. The drawer slide according to claim 15, wherein the spring biasing member is arranged on one of the cabinet member and the drawer member and the spring member is arranged on the other one of the cabinet member and the drawer member.

17. The drawer slide according to claim 1, wherein the drawer slide is arranged to allow the drawer to be extended further away from the cabinet beyond the static extended position to a biased non-static extended position a distance (LF) corresponding to 5-30% of the inner total length (TL) of the drawer.

18. The drawer slide according to claim 1, wherein the drawer biasing means includes a drawer front raising portion arranged for moving a front of the drawer at least partly vertically upwards upon pulling the drawer outwardly beyond the static extended position, and a spring arrangement arranged to bias the drawer in a direction towards the cabinet upon pulling the drawer further away from the cabinet beyond the static extended position.

19. The drawer slide according to claim 1, wherein the drawer slide is a three quarter extendable drawer slide and is arranged to allow the drawer to be pulled out to a static extended position of a total length (LH+LC) corresponding to maximum 75% of the inner total length (TL) of the drawer.

20. The drawer slide according to claim 19, wherein the total length (LH+LC) corresponds to maximum 70% of the inner total length (TL) of the drawer.

21. The drawer slide according to claim 19, wherein the drawer slide is arranged to allow the drawer to be pulled out to a static extended position having a total length (LH+LC) corresponding to maximum 50-70% of the inner total length (TL) of the drawer.

22. The drawer slide according to claim 19, wherein the drawer slide is arranged to allow the drawer to be extended to a non-static extended position at a length (LC+LH+LF) corresponding to maximum 90% of the inner total length (TL) of the drawer and 85% of the inner total length (TL) of the drawer.

23. The drawer slide according to claim 19, wherein the drawer slide is arranged to allow the drawer to be pulled out to a non-static extended position having a total length (LC+LH+LF) corresponding to maximum 65-85% of the inner total length (TL) of the drawer.

24. A cabinet and drawer combination comprising:

a cabinet;

at least one drawer arranged in the cabinet;

at least one drawer slide for guiding the at least one drawer in an essentially linear movement as the at least one drawer is pulled out from the cabinet to a static extended position;

wherein the at least one drawer slide includes (a) a drawer member configured for extending along a right side or a left side of the at least one drawer, wherein the at least one drawer has a front side and a back side;

(b) a cabinet member configured for extending along the cabinet, wherein the drawer member is configured to move relative to the cabinet member for guiding the at least one drawer as the at least one drawer is pulled out from the cabinet to the static extended position; and (c) drawer biasing means for biasing the at least one drawer in a direction towards the cabinet only after pulling the at least one drawer further away from the cabinet beyond the static extended position to a biased non-static extended position, and wherein the at least one drawer slide is constructed such that the at least one drawer is extendable further away from the cabinet beyond the static extended position to the biased non-static extended position.

25. A method of controlling a drawer being connected to a drawer slide for guiding the drawer in an essentially linear movement as the drawer is pulled out from a cabinet to a static extended position, wherein the drawer slide includes (a) a drawer member configured for extending along a right side or a left side of the drawer, wherein the drawer has a front side and a back side, (b) a cabinet member configured for extending along the cabinet, wherein the drawer member is configured to move relative to the cabinet member for guiding the drawer as the drawer is pulled out from the cabinet to the static extended position, and (c) drawer biasing means for biasing the drawer in a direction towards the cabinet only after pulling the drawer further away from the cabinet beyond the static extended position to a biased non-static extended position; the method comprising:

the drawer biasing means biasing the drawer in a direction towards the cabinet upon pulling the drawer further away from the cabinet beyond the static extended position to a biased non-static extended position.

* * * * *